US009909390B2

(12) United States Patent
McNabb et al.

(10) Patent No.: US 9,909,390 B2
(45) Date of Patent: Mar. 6, 2018

(54) STAGE TOOL WITH LOWER TUBING ISOLATION

(71) Applicant: Weatherford Technology Holdings, LLC, Houston, TX (US)

(72) Inventors: Bryce McNabb, Spruce Grove (CA); Jozeph Robert Marcin, Spruce Grove (CA); Andrew J. Hanson, Edmonton (CA); James MacTavish, Edmonton (CA); Corey Kshyk, Edmonton (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 221 days.

(21) Appl. No.: 14/719,560

(22) Filed: May 22, 2015

(65) Prior Publication Data

US 2015/0345252 A1 Dec. 3, 2015

Related U.S. Application Data

(60) Provisional application No. 62/117,244, filed on Feb. 17, 2015, provisional application No. 62/004,683, filed on May 29, 2014.

(51) Int. Cl.

| | |
|---|---|
| ***E21B 33/14*** | (2006.01) |
| ***E21B 34/12*** | (2006.01) |
| *E21B 34/00* | (2006.01) |

(52) U.S. Cl.

CPC ..... *E21B 34/12* (2013.01); *E21B 2034/005* (2013.01)

(58) Field of Classification Search

CPC .. E21B 34/12; E21B 2034/005; E21B 33/146; E21B 34/14; E21B 33/16

USPC ..... 166/318

See application file for complete search history.

(56) References Cited

U.S. PATENT DOCUMENTS

| | | | | |
|---|---|---|---|---|
| 3,768,562 | A | 10/1973 | Baker | |
| 5,044,443 | A | 9/1991 | Churchman et al. | |
| 5,411,095 | A | 5/1995 | Ehlinger et al. | |
| 8,757,274 | B2 | 6/2014 | Skinner et al. | |
| 8,800,655 | B1 * | 8/2014 | Bailey | E21B 33/146 166/177.4 |

(Continued)

FOREIGN PATENT DOCUMENTS

| | | | |
|---|---|---|---|
| WO | 2009/024753 | A1 | 2/2009 |
| WO | 2012100259 | A2 | 7/2012 |

OTHER PUBLICATIONS

Canadian Office Action dated Apr. 26, 2016, for Canadian Patent Application No. 2,892,736.

(Continued)

*Primary Examiner* — Taras P Bemko

(74) *Attorney, Agent, or Firm* — Patterson + Sheridan, LLP

(57) ABSTRACT

A stage tool includes an isolation mechanism for isolating the lower bore of a completion string. The isolation mechanism is initially in a deactivated configuration until sufficient hydraulic pressure is applied, at which time, the isolating mechanism is activated to isolate the lower bore from cement ingress. Concurrently or subsequently, a stage tool may be opened to facilitate cementing of an annulus between the completion string and the wellbore. After cementing, the isolation mechanism, or portions thereof, may be drilled out to re-establish flow through the stage tool.

15 Claims, 40 Drawing Sheets

(56) References Cited

U.S. PATENT DOCUMENTS

| | | | | |
|---|---|---|---|---|
| 2002/0033262 | A1* | 3/2002 | Musselwhite | E21B 17/14 166/285 |
| 2006/0124310 | A1 | 6/2006 | Lopez de Cardenas et al. | |
| 2009/0065194 | A1 | 3/2009 | Frazier | |
| 2012/0247767 | A1 | 10/2012 | Themig et al. | |
| 2014/0246207 | A1 | 9/2014 | Hofman et al. | |
| 2014/0332277 | A1* | 11/2014 | Churchill | E21B 21/103 175/57 |

OTHER PUBLICATIONS

GB Search and Examination Report dated Oct. 13, 2015 for Application No. 1509252.1.

* cited by examiner

STAGE TOOL WITH LOWER TUBING ISOLATION

CROSS-REFERENCE TO RELATED APPLICATIONS

This application claims benefit of U.S. Provisional Patent Application Ser. No. 62/004,683, filed May 29, 2014, and U.S. Provisional Patent Application Ser. No. 62/117,244, filed Feb. 17, 2015, which are herein incorporated by reference.

BACKGROUND OF THE DISCLOSURE

Field of the Disclosure

Embodiments of the present disclosure generally relate to a stage tool for use in open-hole completions.

Description of the Related Art

A wellbore completion string generally includes a stage cementing tool, a casing string or liner, and a toe sleeve. Stage cementing tools enable cementing of the casing string or the liner in the wellbore in two or more stages. Current hydraulic stage tool technology cannot positively indicate which of the stage tool, the toe sleeve, or both, has opened due to the application of hydraulic pressure, which may lead to cementing of undesired sections of the completion string in the wellbore. The undesired cement may foul tools below the stage tool in the completion string, which may no longer function properly due to the fouling. Cementing of undesired sections may also prevent cementing of a desired section and thus result in an inadequate cement job, which may need to be corrected.

SUMMARY OF THE DISCLOSURE

The present disclosure generally relates to a stage tool including an isolation mechanism for isolating the lower bore of a completion string. The isolation mechanism is initially in a deactivated configuration. When sufficient hydraulic pressure is applied, the isolation mechanism is activated to isolate the lower bore from cement ingress. Concurrently or subsequently, a stage tool may be opened to facilitate cementing of an annulus between the completion string and the wellbore. After cementing, the isolation mechanism, or portions thereof, may be drilled out to re-establish flow through the stage tool.

In one embodiment, a stage tool includes a tubular body having one or more ports formed through a sidewall thereof; and an isolation mechanism disposed in the tubular body, the isolation mechanism having a window sub; a flapper mount coupled to the window sub; a flapper coupled to the flapper mount, the flapper pivotable from an open position to a closed position; an opening sleeve axially movable from a first position that closes the one or more ports to a second position that exposes the one or more ports; and a closing sleeve axially movable from a first position that exposes the one or more ports to a second position that closes the one or more ports.

In another embodiment, a stage tool includes a tubular body having one or more ports formed through a sidewall thereof; and an isolation mechanism disposed in the tubular body, the isolation mechanism has a closing sleeve; a window sub coupled to the closing sleeve, the window sub including a radially-inward tapered surface; one or more wedges coupled by shearable fasteners to the window sub, the one or more wedges each having tapered surfaces adapted to engage the radially-inward tapered surface of the window sub; and an opening sleeve axially movable from a first position that closes the one or more ports to a second position that exposes the one or more ports, wherein movement of the opening sleeve from the first position to the second position shears the shearable fasteners and actuates the one or more wedges along the radially-inward tapered surface of the window sub; and a closing sleeve axially movable from a first position that exposes the one or more ports to a second position that closes the one or more ports.

In another embodiment, a stage tool includes a tubular body having one or more ports formed through a sidewall thereof; and an isolation mechanism disposed in the tubular body, the isolation mechanism has a closing sleeve; a stud housing adjacent to the closing sleeve, the stud housing having one or more ports disposed axially therethrough; an opening sleeve axially movable from a first position that closes the one or more ports in the tubular body to a second position that exposes the one or more ports in the tubular body, wherein the opening sleeve closes the one or more ports disposed axially through the stud housing when in the second position.

In another embodiment, a stage tool includes a tubular body having one or more ports formed through a sidewall thereof; and an isolation mechanism disposed in the tubular body, the isolation mechanism has a window sub; a flapper mount coupled to the window sub; a flapper coupled to the flapper mount, the flapper pivotable from an open position to a closed position; an opening sleeve axially movable from a first position that closes the one or more ports to a second position that exposes the one or more ports, wherein the opening sleeve maintains the flapper in the open position when the opening sleeve is in the first position; and a closing sleeve axially movable from a first position that exposes the one or more ports to a second position that closes the one or more ports.

In another embodiment, a stage tool includes a tubular body having one or more ports formed through a sidewall thereof; and an isolation mechanism disposed in the tubular body, the isolation mechanism has a window sub; a flapper mount coupled to the window sub; a flapper coupled to the flapper mount, the flapper pivotable from an open position to a closed position; an opening sleeve axially movable from a first position that closes the one or more ports to a second position that exposes the one or more ports; a flapper shaft axially movable from a first position that maintains the flapper in the open position to a second position that allows the flapper to pivot to the closed position; and a closing sleeve axially movable from a first position which exposes the one or more ports to a second position which closes the one or more ports.

In another embodiment, a stage tool includes a tubular body having one or more ports formed through a sidewall thereof; and an isolation mechanism disposed in the tubular body, the isolation mechanism has a window sub; a flapper mount coupled to the window sub, the flapper mount having one or more j-slots formed therein; a flapper coupled to the flapper mount, the flapper pivotable from an open position to a closed position; an opening sleeve axially movable from a first position that closes the one or more ports to a second position that exposes the one or more ports; and a closing sleeve axially movable from a first position that exposes the one or more ports to a second position that closes the one or more ports.

In another embodiment, a method of operating a shifting tool includes applying a pressure differential to an opening sleeve within a shifting tool, thereby shearing one or more shearable fasteners and axially actuating the opening sleeve;

and actuating a sealing mechanism to form a seal within the shifting tool to prevent flow therethrough.

In another embodiment, a method of verifying closure of a tubing isolation device within a tubular includes measuring a first fluid volume required to reach a threshold pressure within the tubular sufficient to actuate an isolation mechanism within the isolation device; relieving the pressure within the tubular; measuring a second fluid volume required to reach the threshold pressure; and comparing the first fluid volume to the second fluid volume.

In another embodiment, a stage tool includes a tubular body having one or more ports formed through a sidewall thereof; an opening sleeve axially movable from a first position that closes the one or more ports to a second position that exposes the one or more ports; a closing sleeve axially movable from a first position that exposes the one or more ports to a second position that closes the one or more ports; an isolation mechanism disposed in the tubular body; the isolation mechanism comprising a window sub; a flapper mount coupled to the window sub; and a flapper release sleeve adapted to hold the flapper in an open position.

In another embodiment, a stage tool includes a tubular body having one or more ports formed through a sidewall thereof; and an isolation mechanism disposed in the tubular body, the isolation mechanism having: a window sub; a plurality of pins coupled to the window sub and extending radially inward from the window sub; a rotatable ball valve having a plurality of grooves formed in a surface thereof, the rotatable ball valve disposed radially inward of and in contact with the window sub, wherein the each pin of the plurality of pins is disposed within a respective groove of the plurality of grooves of the rotatable ball valve; an opening sleeve axially movable from a first position that closes the one or more ports to a second position that exposes the one or more ports; and a closing sleeve axially movable from a first position that exposes the one or more ports to a second position that closes the one or more ports.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure generally relates to a stage tool including an isolation mechanism for isolating the lower bore of a completion string disposed in a wellbore. The isolation mechanism is initially in a deactivated configuration until sufficient hydraulic pressure is applied, thus activating and isolating the lower bore from cement ingress. Concurrently or subsequently, the stage tool may be opened to facilitate cementing of an annulus between the completion string and the wellbore. After cementing, the isolation mechanism, or portions thereof, may be drilled out to re-establish flow through the stage tool.

Figure 1:
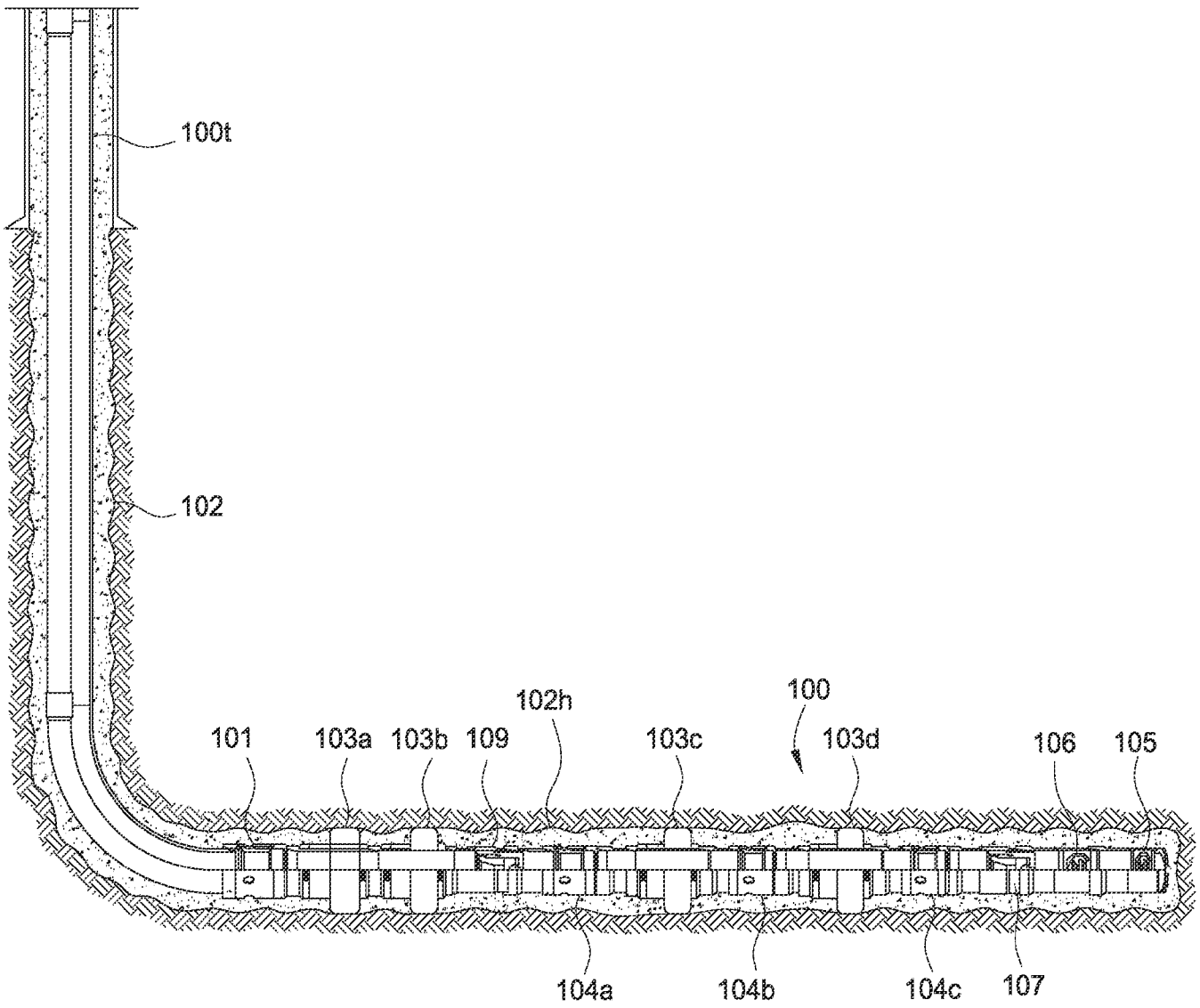
FIG. 1 illustrates a fracking assembly including a stage tool having an isolation mechanism, according to one embodiment of the disclosure.

FIG. 1 illustrates a hydraulic fracturing assembly 100, e.g., a "fracking assembly" 100, including a stage tool 101 having an isolation mechanism, according to one embodiment of the disclosure. The fracking assembly 100 includes a tubular 100*t*, such as liner or casing, positioned within a horizontal portion 102*h* of a wellbore 102. The tubular 100*t* includes one or more packers 103*a,b,c,d* (four are shown) positioned therearound and spaced in intervals from one another. The packers 103*a,b,c,d* may be adapted to form a seal between the horizontal portions 102*h* of the wellbore 102 and the tubular 100*t*. The fracking assembly 100 also includes one or more fracking devices 104*a,b,c*, such as sliding sleeves, for fracturing a hydrocarbon-bearing reservoir. The one or more fracking devices 104*a,b,c* may be positioned between the packers 103*a,b,c,d* to facilitate isolated fracking production from desired regions of the hydrocarbon-bearing reservoir. A float shoe 105 and a float collar 106 may be disposed at a distal end (e.g., the toe end) of the tubular 100*t*. The float shoe 105 may include a one-way check valve therein to prevent reverse flow or U-tubing. A ball seat 107 is positioned adjacent to and up hole of the float collar 106. The ball seat 107 is adapted to receive a plug, such as a ball, to prevent flow therethrough and facilitate a pressure increase within the tubular 100*t*.

During operation, a plug such as a ball (not shown) is launched down hole and lands in the ball seat 107 to restrict flow therethrough. As fluid is pumped into the tubular 100*t*, pressure therein increases to set the packers 103*a,b,c,d*. After setting of the packers 103*a,b,c,d*, the stage tool 101 is operated to facilitate cementing of the annulus between the vertical portion of the tubular 100*t* and the wellbore 102. Cement is pumped down hole into the tubular 100*t*, and chased with a wiper plug which may land in the stage tool 101. As cement is forced through ports in the stage tool and into the annulus, cement is prohibited from traveling towards the distal end of the wellbore by the packer 103*a* adjacent the stage tool 101, and prohibited from traveling down below the stage tool 101 by an isolation mechanism disposed with the stage tool 101. The stage tool 101 may then be drilled out to re-establish flow through the tubular 100*t*. A debris sub 109 may be located down hole of the stage tool 101 to catch debris of the stage tool 101 during the drill out process and to ensure adequate drilling of the stage tool 101 components.

Figure 2A:
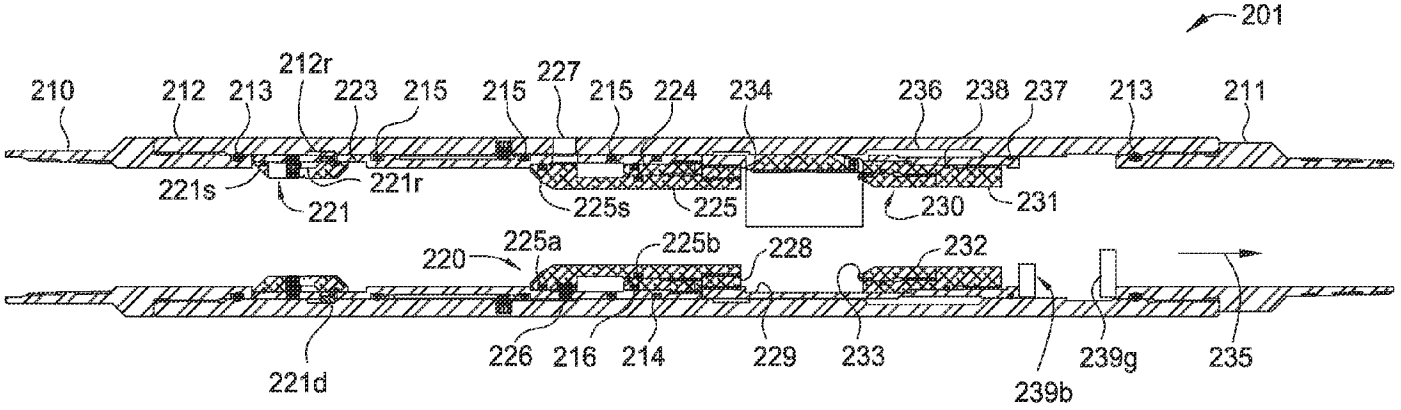
FIGS. 2A-2E illustrate operation of a shifting tool having an isolation mechanism, according to one embodiment of the disclosure.
Figure 2B:
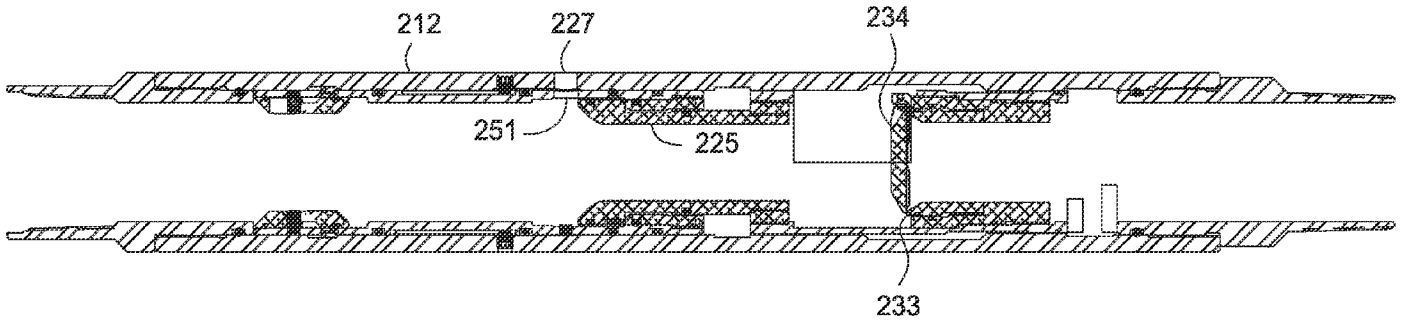

FIGS. 2A-2E illustrate operation of a shifting tool 201 having an isolation mechanism 220, according to one embodiment of the disclosure. FIG. 2F illustrates a flapper coupled to a flapper mount, according to one embodiment of the disclosure. FIG. 2A illustrates the shifting tool 201 in a run-in-hole configuration. The shifting tool 201 includes a tubular member having a top sub 210, a bottom sub 211, and a body 212 disposed therebetween and coupled thereto, for example, by a threaded connection. It is contemplated that the tubular body may be single member, or formed from multiple members as shown. One or more seals 213, such as o-rings, may be disposed between the body 212 and each of the top sub 210 and the bottom sub 211 to facilitate sealing therebetween. Each of the top sub 210 and the bottom sub 211 may be coupled to additional joints of liner or casing via a stabbing/receiving connection, a threaded connection, or the like, as illustrated in FIG. 1.

The isolation mechanism 220 is disposed within the body 212 and coupled to an internal surface thereof. The isolation mechanism 220 includes a closing seat assembly 221 having seats 221*s* on upward side thereof. The closing seat assembly 221 is coupled to a closing sleeve 223 by shearable fasteners 242. The closing sleeve 223 includes dogs 221*d* which are positioned in a recess 212*r* in the radially inward side of the body 212 during the run-in hole orientation. The dogs 221*d* may be outwardly biased to engage a recess 221*r* formed in a radially outward surface of the closing seat assembly 221 during a port closing operation, as explained in more detail below.

The closing sleeve 223 may be releasably coupled to the body 212 by a releasable connection 214, such as a snap ring or a shearable fastener. One or more seals 215, such as o-rings, may facilitate sealing between the body 212 and the closing sleeve 223. A sleeve retainer 224 is coupled, such as by a threaded connection, to an end of the closing sleeve 223, and one or more seals 216, such as o-rings, may facilitate sealing therebetween. An opening sleeve 225 is disposed radially inward of the sleeve retainer 224 and releasably coupled to the closing sleeve 223 by a shearable fastener 226. As shown in FIG. 2A, when positioned in the run-in-hole configuration, the opening sleeve 225 is positioned to prevent flow of a fluid through one or more ports 227 (one is shown) formed in body 212.

A radially outward surface of the opening sleeve 225 is coupled, via an adapter 228, to a radially inward surface of a window sub 229. In one example, the window sub 229 is a ring or cylinder having a threaded inner surface. A radially outward surface of the window sub 229 is disposed adjacent to and in contact with the radially inward surface of the body 212. The window sub 229 extends axially along the inner surface of the body 212 and facilitates support of the flapper sub assembly 230. A seal 237, such as an o-ring, facilitates sealing between the window sub 229 and the body 212. The flapper sub assembly 230 includes a flapper mount 231 coupled to a radially inward surface of the window sub 229. One or more connectors 238, such as a pin, facilitate coupling between the window sub 229 and the flapper sub assembly 230. A lower (e.g., down hole) portion 239*b* of the window sub 229 functions as an anti-rotation sub which may optionally mate with one or more profiles 239*g* to prevent or reduce rotation during a subsequent drill out operation. While the window sub 229 having anti-rotation functionality is illustrated as a single component, it is contemplated that a distinct anti-rotation sub may be coupled to a down hole end of the window sub 229, for example, by welding, threaded connection, or the like.

The flapper mount 231 includes a hard seat 232 having a soft seat 233, such as a rubber seal, at an upper end thereof. In one example, the soft seat 233 may function as a primary seal, while the hard seat 232 may function as a secondary seal. The soft seat 233 is adapted to be contacted by a sealing mechanism, such as a flapper 234 that is pivotably mounted to the flapper mount 231 to form a seal therebetween, thus isolating a down hole portion of the bore by preventing fluid flow therethrough. The down hole direction is illustrated by arrow 235. The flapper 234 is coupled to the flapper mount 231 via a pin 234*p*. The flapper 234 is biased towards the closed position by a torsion spring 234*s* mounted around the pin 234*p* (shown in FIG. 2F). In the run-in-hole configuration illustrated in FIG. 2A, the flapper 234 of the flapper sub assembly 230 remains open (e.g., allows fluid flow therethrough) due to an interference fit between the flapper 234 and an internal surface of the body 212 which prevents the flapper 234 from closing. A recess 236, disposed axially down hole of the flapper 234 in the run-in-hole configuration, is formed on the internal surface of the body 212 and provides clearance to allow the flapper 234 to pivotally close via bias from the spring 234*s* when the flapper 234 is shifted adjacent to the recess 236, as explained with respect to FIG. 2B.

The run-in-hole orientation of the shifting tool 201 (e.g., the open flapper position) allows the passage of fluids, plugs, and the like axially therethrough to facilitate operations down hole of the shifting tool 201. However, the run-in-hole configuration substantially prevents the passage of fluid through the ports 227, as passage therethrough is prevented by the opening sleeve 225. During operation, when it is desired to open the ports 227, a plug (not shown) may be pumped down hole for seating within the ball seat 107 (shown in FIG. 1). Seating of the plug prevents fluid flow therethrough and allows the pressure within the tubular 100*t* to be increased as fluid is pumped into tubular 100*t*. The pressure increase within the tubular 100*t* results in a pressure differential across an opening sleeve 225 due to the varying sealing diameters formed by the seals 225*a* and 225*b*, which forces the opening sleeve 225 in a down hole direction to shear the shearable fastener 226. The larger seal diameter of 225*a* relative to 225*b* creates a net downhole force when the tubing string is pressurized. Once the pressure differential reaches a predetermined limit, the shearable fastener 226 shears, allowing the opening sleeve 225 to move in the down hole direction, as shown in FIG. 2B. The opening sleeve 225 is moved until shouldered upon the sleeve retainer 224.

Actuation of the opening sleeve 225 concurrently results in the axial movement of the window sub 229. Actuation of the window sub 229 positions the flapper 234 adjacent the recess 236, thus removing the interference fit that holds the flapper 234 in an open position, and thereby allowing the torsion from the spring 234*s* to pivot the flapper 234 into a closed position, as illustrated in FIG. 2B. In the closed position, the flapper 234 contacts the soft seat 233 to provide a fluid seal thereagainst, thus isolating an up hole portion of the wellbore from a down hole portion of the wellbore or substantially restricting flow through the shifting tool 201 should a complete seal not occur In an alternative embodiment, the flapper 234 may include multiple flapper components, for example, the flapper 234 may be a tri-flapper including three flapper elements.

As illustrated in FIG. 2B, the down hole axial actuation of the opening sleeve 225 results in opening of the one or more ports 227 (one is shown) through the body 212, thus allowing fluids, such as a cementing slurry, that are pumped into the tubular 100*t* (shown in FIG. 1) to enter the annulus 102 surrounding the tubular 100*t*. The fluid that enters the annulus is prevented from traveling in a down hole direction by a previously-set packer, such as packer 103*a*, located down hole of the one or more ports 227. Thus, as fluid is pumped into the tubular 100*t*, it is forced into an up hole portion of the annulus to facilitate cementing thereof.

Figure 2C:
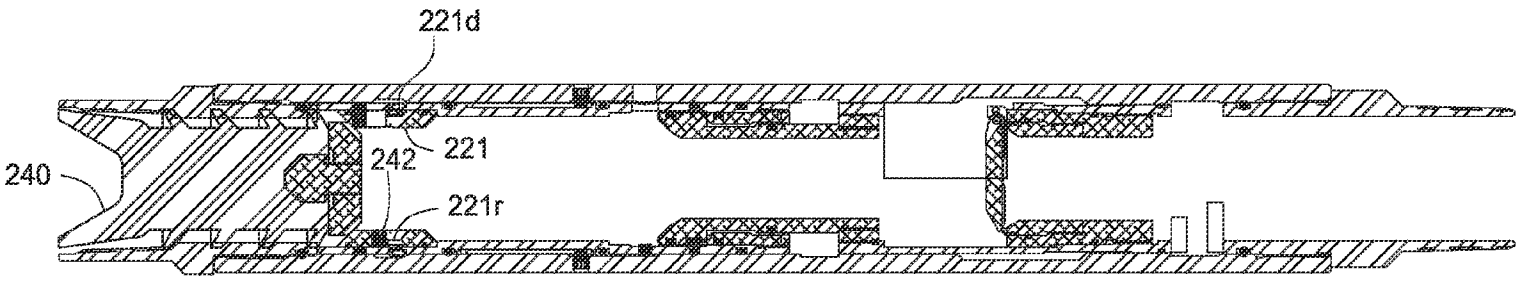
Figure 2D:
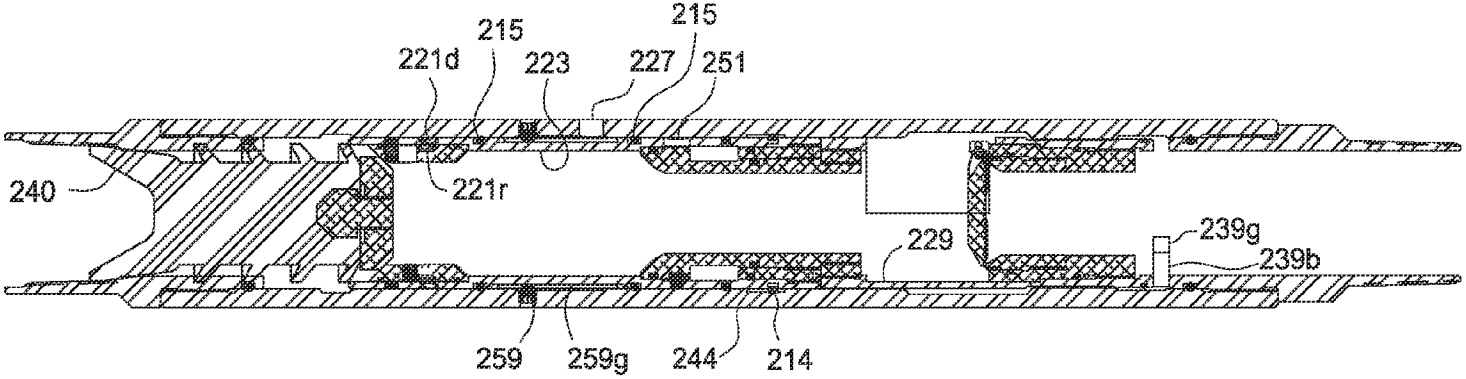

After a desired amount of fluid, such as cementing slurry, has been pumped into tubular 100*t*, a wiper plug 240 is launched into the tubular 100*t*, as shown in FIG. 2C. A chaser fluid (not shown) may be pumped into the tubular 100*t* after launching the wiper plug 240 in order to force the wiper plug 240 down hole. The wiper plug 240 travels down the bore of the tubular 100*t* and engages the seat 221*s* of the closing seat assembly 221 (shown in FIG. 2C). Continued pumping of chaser fluid behind the wiper plug 240, and the resulting pressure increase created thereby, facilitates shearing of a shearable faster 242 thereby allowing the closing seat assembly 221 to move axially down hole. Axial movement of the closing seat assembly 221 allows the dogs 221*d* to move radially inward into a recess 221*r* as the recess 221*r* is moved adjacent to the dogs 221*d*, as shown in FIG. 2D.

Figure 2E:
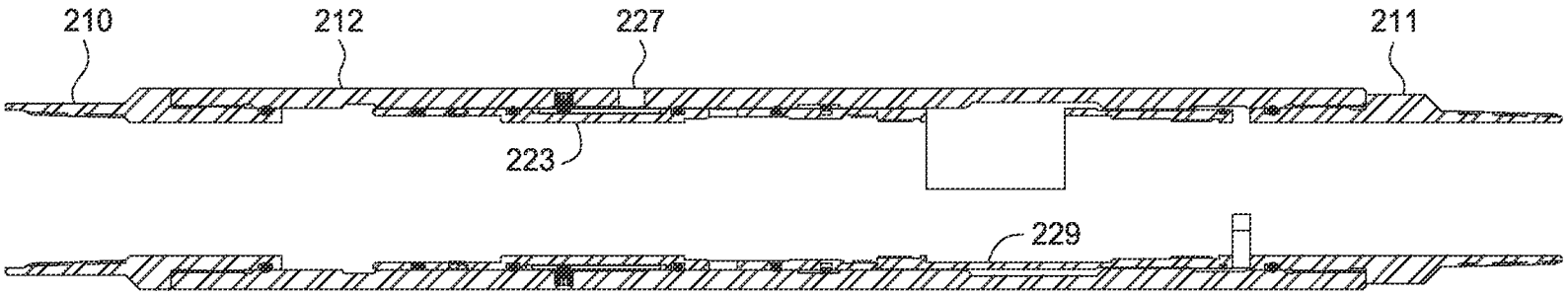
Figure 2F:
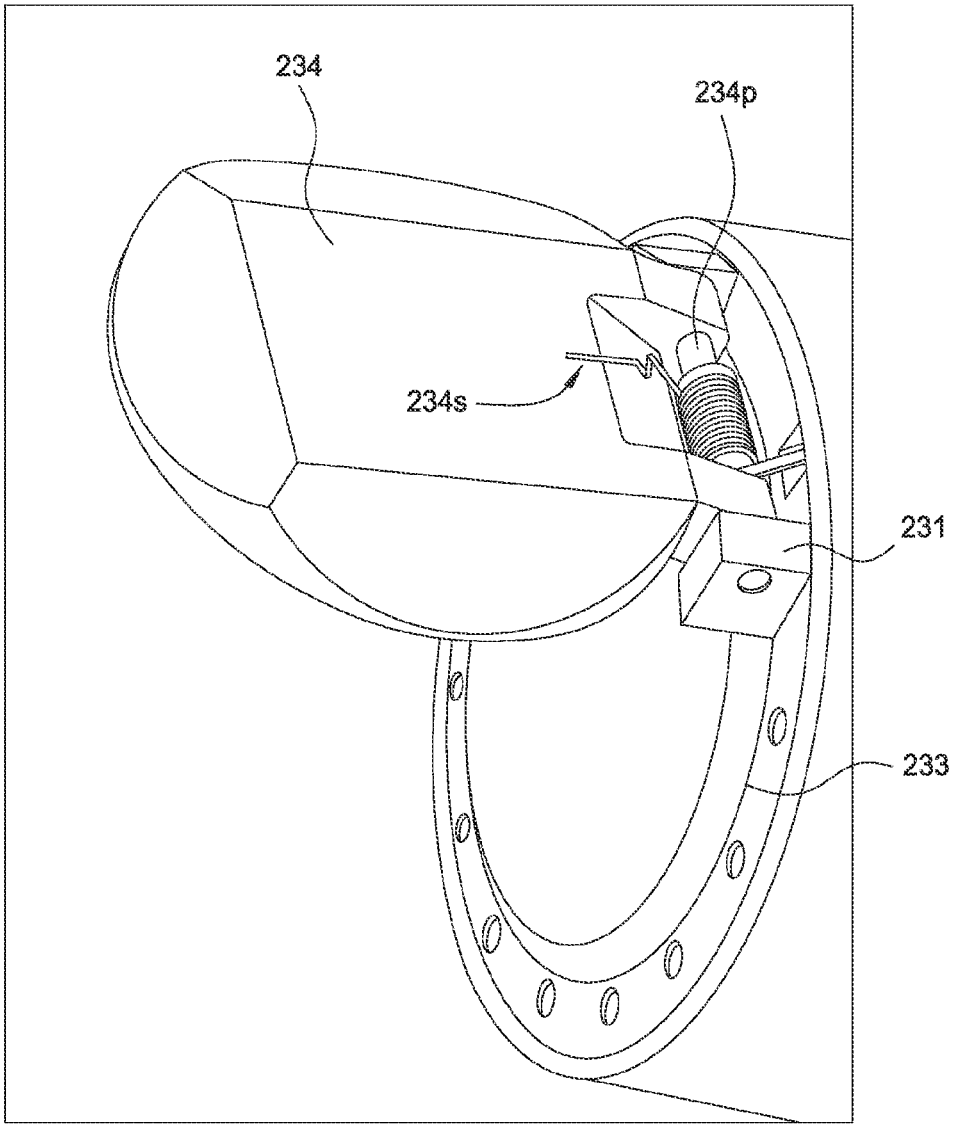
FIG. 2F illustrates a flapper coupled to a flapper mount, according to one embodiment of the disclosure.

The inward radial movement of the dogs 221*d* allows the closing sleeve 223 to move axially in response to the downward force of the wiper plug 240 on the seat 221*s* by disengaging the dogs 221*d* from the recess 212*r*. During actuation of the closing sleeve 223, alignment of the closing sleeve 223 is maintained by one or more alignment screws 259 located within corresponding alignment grooves 259*g* The axial movement of the closing sleeve 223 results in closing and/or sealing of the one or more ports 227 by the seals 215 on the closing sleeve 223, as shown in FIG. 2D, and misalignment of a port 251 in the closing sleeve 223 with the port 227. The axial movement of the closing sleeve 223 also results in contact between the closing sleeve 223 and the window sub 229, as well as simultaneous contact between the closing sleeve and the top of the opening sleeve 225, and consequently, axially downward actuation of the window sub 229. The axial movement of the closing sleeve 223 forces the window sub 229 against the bottom sub 211, and placement of the outwardly-biased snap-ring 214 within a recess 244. In this position any fluid which ingresses into the tubing string from below the stage tool, perhaps due to a leak, may lift the flapper and vent back up the tubing string. Alternately, the flapper 234 may be locked closed to prevent ingress up the tubing string. Subsequently, the circulation through the bore may be re-established by a drilling operation which removes the wiper plug 240, the closing seat assembly 221, the opening sleeve 225, the sleeve retainer 224, the adapter 228, the flapper 234, the flapper mount 231, the hard seat 232, and the soft seat 233, as shown in FIG. 2E. In one example, the closing sleeve 223 and the window sub 229 may remain after drilling to maintain closure of port 227.

Figure 3A:
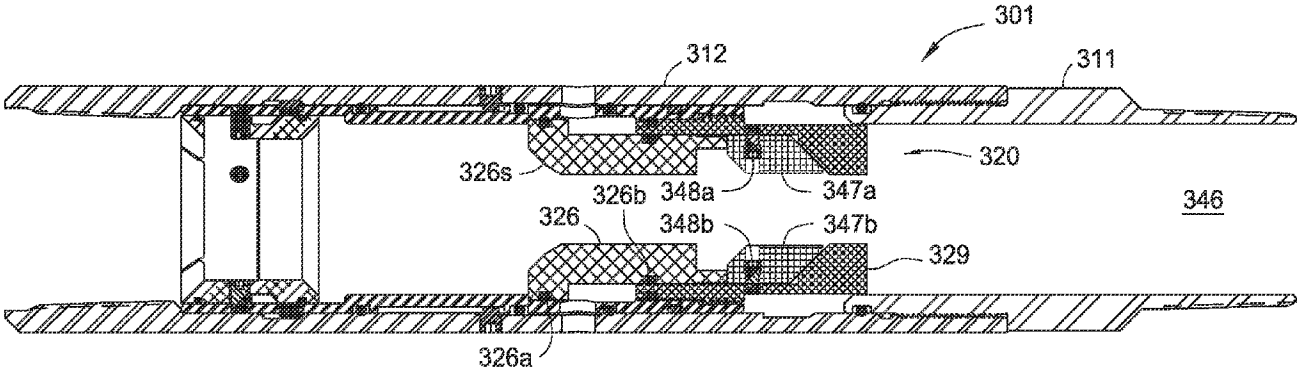
FIGS. 3A-3D illustrate operation of a shifting tool having an isolation mechanism, according to another embodiment of the disclosure.
Figure 3B:
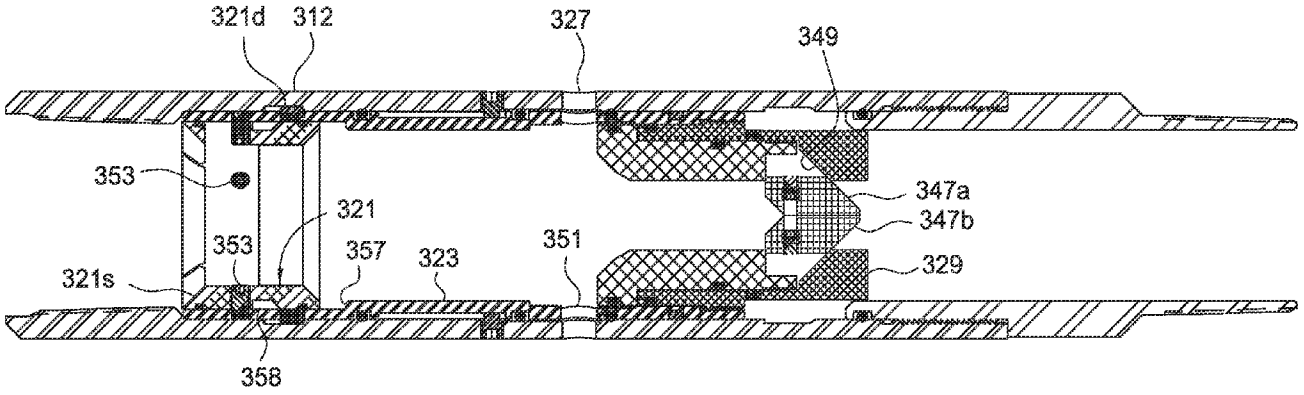

FIGS. 3A-3D illustrate operation of a shifting tool 301 having an isolation mechanism 320, according to another embodiment of the disclosure. The shifting tool 301 operates similarly to the shifting tool 201 described above. FIG. 3A illustrates the shifting tool 301 in a run-in-hole orientation, which allows fluids, darts, plugs, and the like to pass axially therethrough. The shifting tool 301 includes a tubular body having a body 312 and a lower sub 311. It is contemplated that the tubular body may be single member, or formed from multiple members as shown. FIG. 3B illustrates the shifting tool 301 during a closing operation. After pumping a ball or plug down hole to facilitate a pressure increase within the bore 346, an opening sleeve 326 is axially actuated in a down hole direction via the application of differential pressure on the seals 326*a*, 326*b* to expose ports 327 and 351.

Specifically, the opening sleeve 326 is in contact with an upper surface of wedges 347*a,b*, which are held in position by respective shearable fasteners 348*a,b* coupled to a window sub 329. While two wedges 347*a,b* are illustrated, it is contemplated that the isolation mechanism 320 may include more than two wedges. Pressure applied to the seat 326*s* is transferred to the wedges 347*a,b* until a threshold pressure is reached, thus shearing the shearable fasteners 348*a,b* and allowing axial movement of the opening sleeve 326 and the wedges 347*a,b*. As the wedges 347*a,b* are forced downward due to the application of pressure on the opening sleeve 326, the wedges 347*a,b* travel radially inward as well as axially along the tapered surfaces 349 of the window sub 329. The wedges 347*a,b* have lower tapered surfaces to engage the tapered surfaces 349 of the window sub 329. The wedges 347*a,b* are urged into contact with one another, as shown in FIG. 3B thus preventing fluid flow or substantially restricting fluid flow through the shifting tool 301. The opening sleeve 326 is axially actuated over an upper portion of the window sub 329 until movement of the opening sleeve 326 is halted by the window sub 329. The window sub 329 is coupled to a closing sleeve 323, such as by a threaded coupling.

Figure 3C:
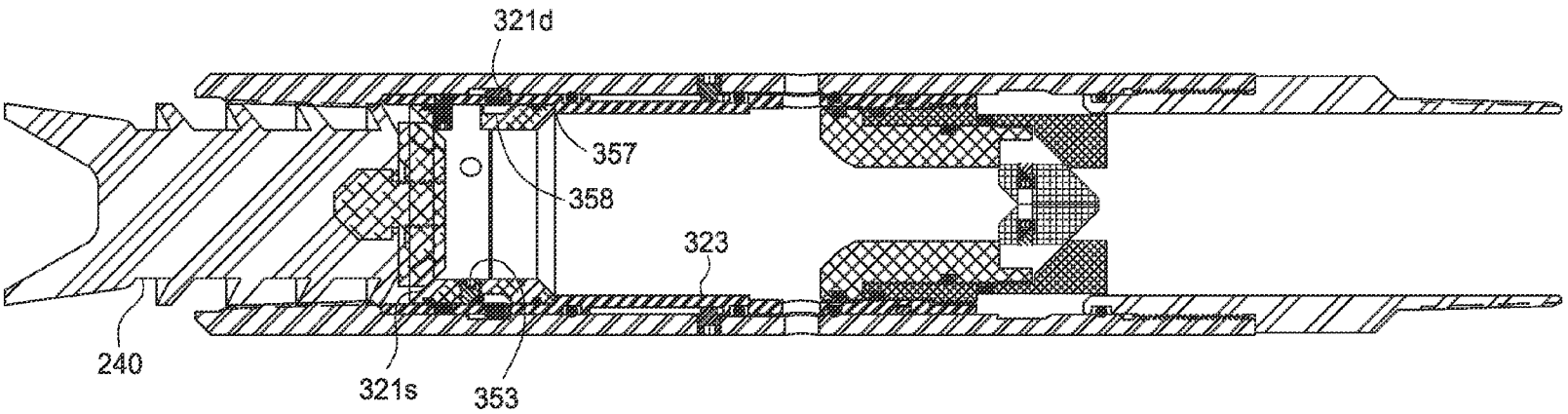

Moreover, axial movement of the opening sleeve 326 results in opening of ports 327 formed in a body 312 of the shifting tool 301. As illustrated in FIG. 3B, the closing sleeve 323 includes one or more ports 351 formed therein, which are aligned with respect to the ports 327 in the run-in-hole orientation to facilitate a cementing operation. With the ports 327 and 351 aligned and open, cementing slurry may pumped down hole and into the annulus. After a desired amount of cementing slurry is pumped down hole, a wiper plug or dart 240 is launched down hole and may be propelled down hole via chaser fluid (not shown). The plug 240 engages a seat 321*s* of a closing seat assembly 321 coupled to the closing sleeve 323 by shearable fasteners 353. FIG. 3C illustrates the plug 240 engaging the seat 321*s*.

Figure 3D:
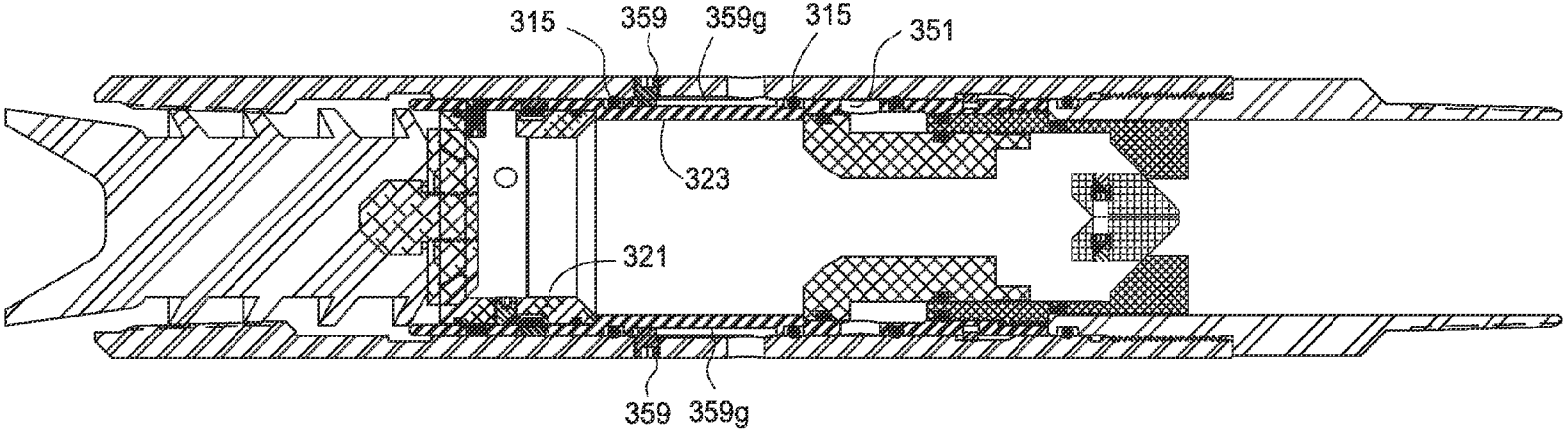

Continued application of pressure on the plug 240 via a chasing fluid results in shearing of the shearable fastener 353, allowing the closing seat assembly 321 to axially move relative to the closing sleeve 323 to engage a shoulder 357 of the closing sleeve 323. Axial movement of the closing seat assembly 321 relative to the closing sleeve 323 allows inwardly-biased dogs 321*d* to move radially inward into one or more recesses 358 formed within a radially outward surface of the closing seat assembly 321. With the dogs 321*d* positioned in the recesses 358, the closing sleeve 323 can freely move in an axial direction as pressure is applied to the plug 240. Axial actuation of the closing sleeve 323 shifts the port 351 relative to the port 327, resulting in closure and/or sealing of the port 327 by the seals 315 of the closing sleeve 323. During actuation of the closing sleeve 323, alignment of the closing sleeve 323 is maintained by one or more alignment screws 359 located within corresponding alignment grooves 359*g*, as shown in FIG. 3D. Optionally, a check valve may be installed in the window sub 329 to allow any leakage into the tubular from below the stage tool 101 to flow up the tubing string. Subsequently, a drilling operation may be performed to re-establish flow through the tubular 100*t*, as similarly described with respect to FIG. 2E.

FIGS. 4A-4E illustrate operation of a shifting tool 401 having an isolation mechanism 420, according to another embodiment of the disclosure. The shifting tool 401 includes a tubular body having a body 312 and a lower sub 311. It is contemplated that the tubular body may be single member, or formed from multiple members as shown. The isolation mechanism 420 is similar to the isolation mechanism 320; however, in the isolation mechanism 420, both the wedges 347*a,b* and the opening sleeve 426 are secured by shearable fasteners in the run-in-hole configuration illustrated in FIG. 4A. The wedges 347*a,b* are coupled to the window sub 329 by respective shearable fasteners 348*a,b*, while the opening sleeve 426 is coupled to the window sub 329 by shearable fasteners 460*a,b*. Thus, closure of the isolation mechanism 420 occurs in two stages.

Figure 4A:
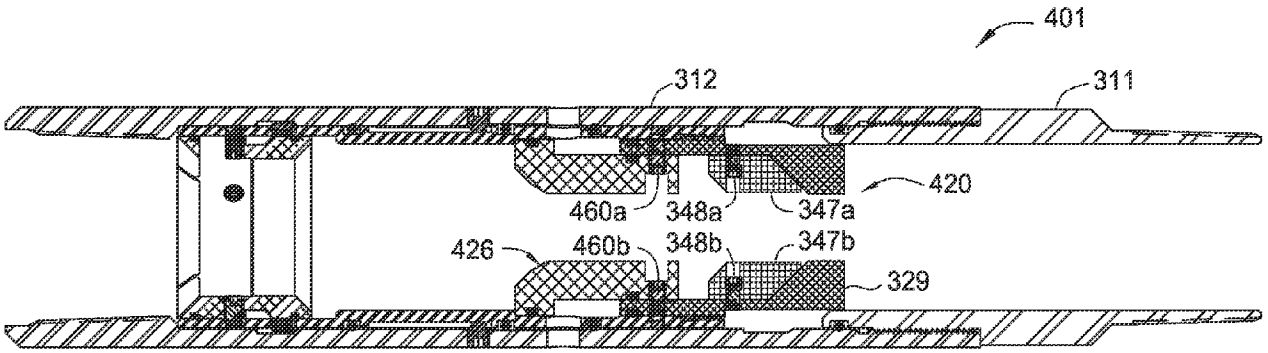
FIGS. 4A-4E illustrate operation of a shifting tool having an isolation mechanism, according to another embodiment of the disclosure.
Figure 4B:
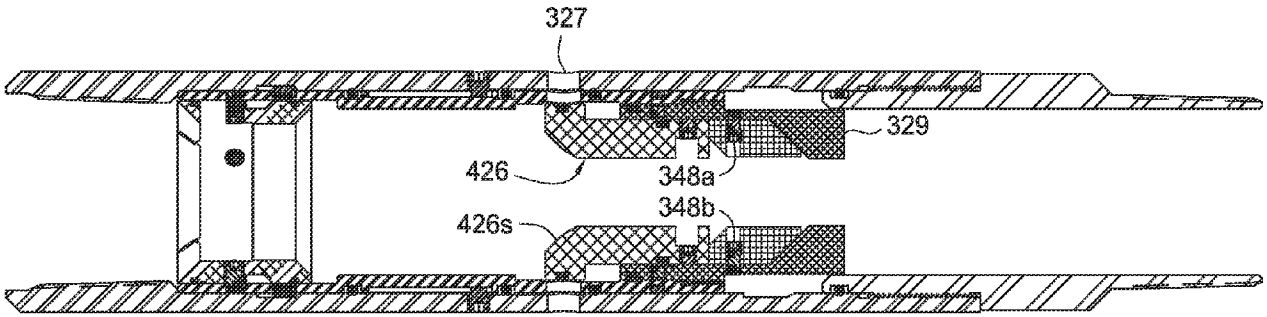
Figure 4C:
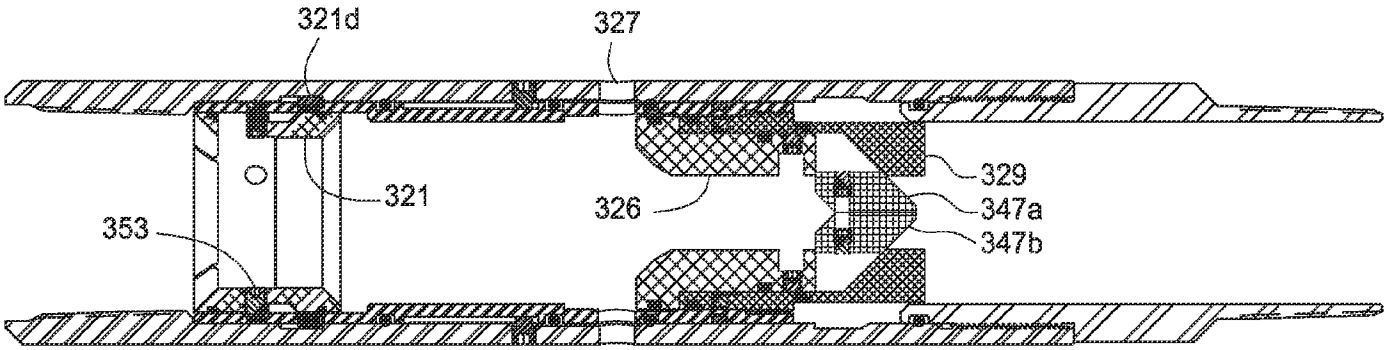
Figure 4D:
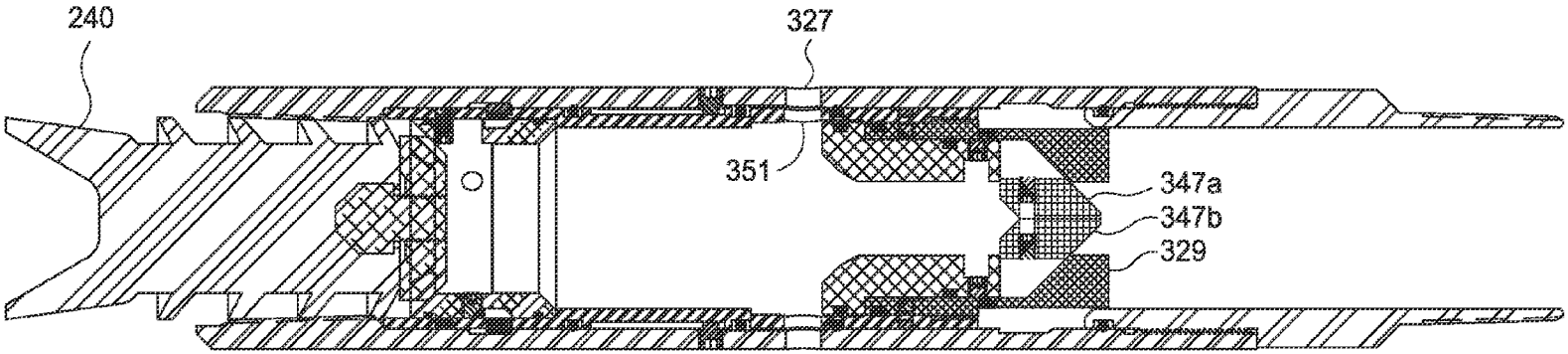
Figure 4E:
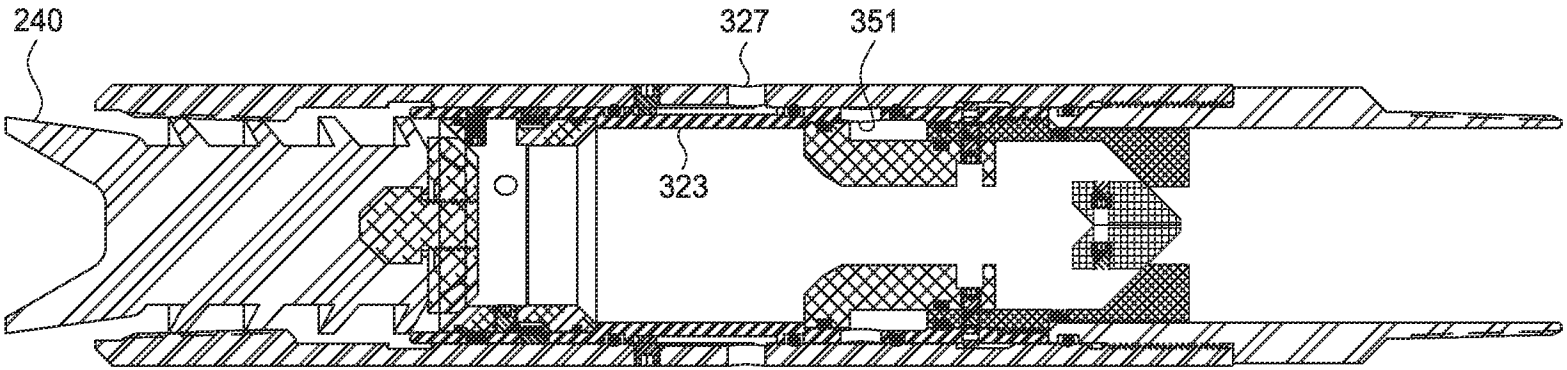

A first stage is illustrated in FIG. 4B, in which pressure is applied to a seat 426*s* of the opening sleeve 426 until a threshold pressure is reached and the shearable fasteners 460*a,b* shear, thus allowing the opening sleeve 426 to move axially relative to the window sub 329. The opening sleeve 426 is actuated axially downward into contact with an upper surface of each wedge 347*a,b*. While two wedges 347*a,b* are illustrated, it is contemplated that the isolation mechanism 420 may include more than two wedges. Pressure is further applied to the opening sleeve 426, which is transferred to the wedges 347*a,b*, until the required threshold force to release the shearable fasteners 348*a,b* is reached. The shearable fasteners 348*a,b* then shear, allowing the wedges 347*a,b*, to travel along the tapered surface of the surface of window sub 329 until engaging one another and fluidly sealing and/or substantially restricting flow through the isolation mechanism 420, as shown in FIG. 4C. FIGS. 4D and 4E are otherwise similar to FIGS. 3C and 3D for performing a cementing operation, pumping the plug 240 into the shifting tool 401, and then moving the closing sleeve 323 to close and seal off the ports 327. The isolation mechanism 420 may then be drilled out to re-establish flow through the shifting tool 401. In an alternative embodiment, it is contemplated that the wedges 347*a,b* may be replaced with a spring-loaded leaf system.

Figure 5A:
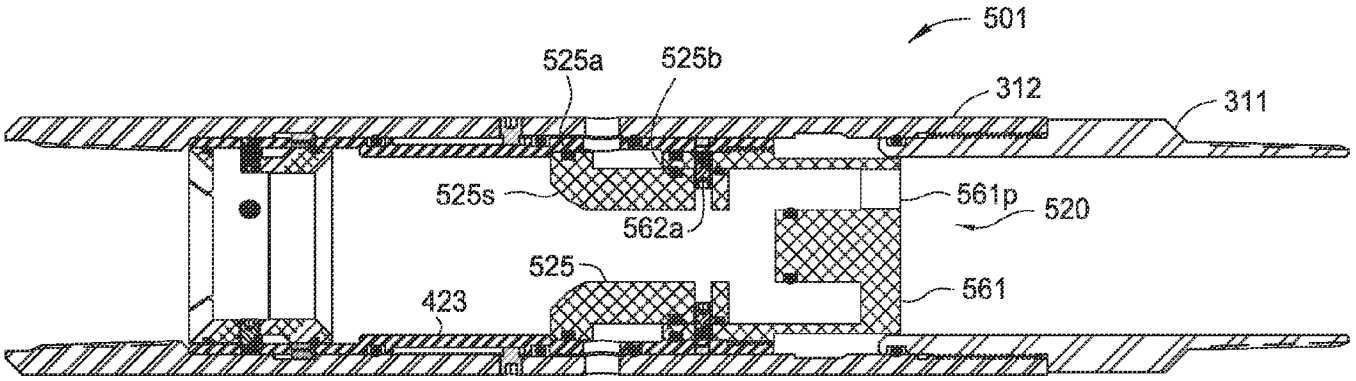
FIGS. 5A-5D illustrate operation of a shifting tool having an isolation mechanism, according to another embodiment of the disclosure.

FIGS. 5A-5D illustrate operation of a shifting tool 501 having an isolation mechanism 520, according to another embodiment of the disclosure. FIG. 5A illustrates the shifting tool 501 and the isolation mechanism 520 in the run-in-hole orientation. The shifting tool 501 includes a tubular body having a body 312 and a lower sub 311. It is contemplated that the tubular body may be single member, or formed from multiple members as shown. The isolation mechanism 520 includes a stud housing 561 coupled, for example by a threaded connection, to a closing sleeve 423. The stud housing 561 includes one or more ports 561*p* (one is shown) disposed axially therethrough. In one example the stud housing 561 includes three ports 561*p* spaced 120 degrees apart. An opening sleeve 525 is coupled to a radially inward surface of the stud housing 561 by one or more shearable fasteners 562*a,b*.

Figure 5B:
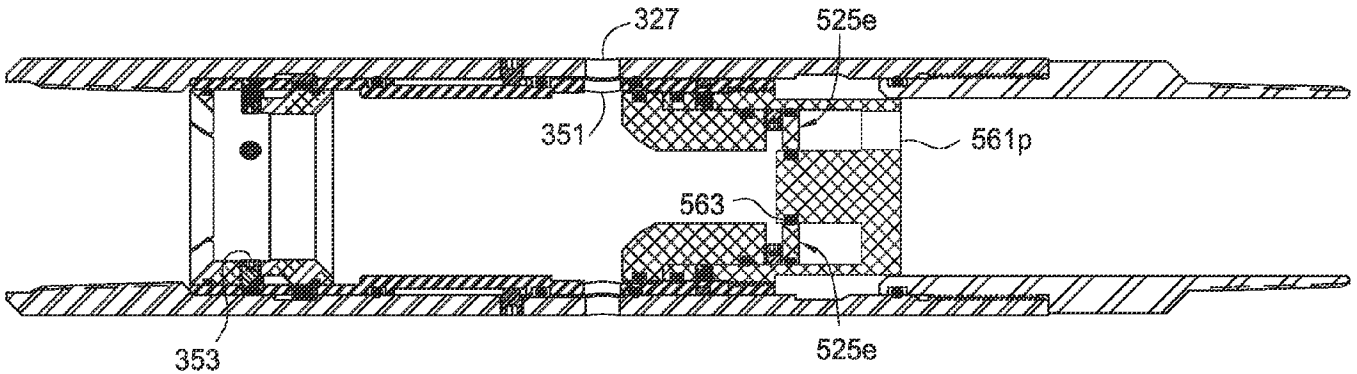

During operation, differential pressure applied to seals 525*a,b* of the opening sleeve 525 results in shearing of the shearable fasteners 562*a,b* upon reaching a threshold force. The opening sleeve 525 is then forced down hole by the applied pressure. As a result of the axial movement of the opening sleeve 525, lower extensions 525*e* of the opening sleeve 525 are positioned within the ports 561*p*, preventing flow therethrough, and thus isolating a lower portion of the bore from an upper portion of the bore, as shown in FIG. 5B. The lower extensions 525*e* may contact one or more seals 563, such as o-rings, to facilitate sealing. Additionally, axially actuation of the opening sleeve 525 results in exposure of the ports 327 and 351, thereby allowing fluid, such as a cementing slurry, to flow therethrough during a cementing operation.

Figure 5C:
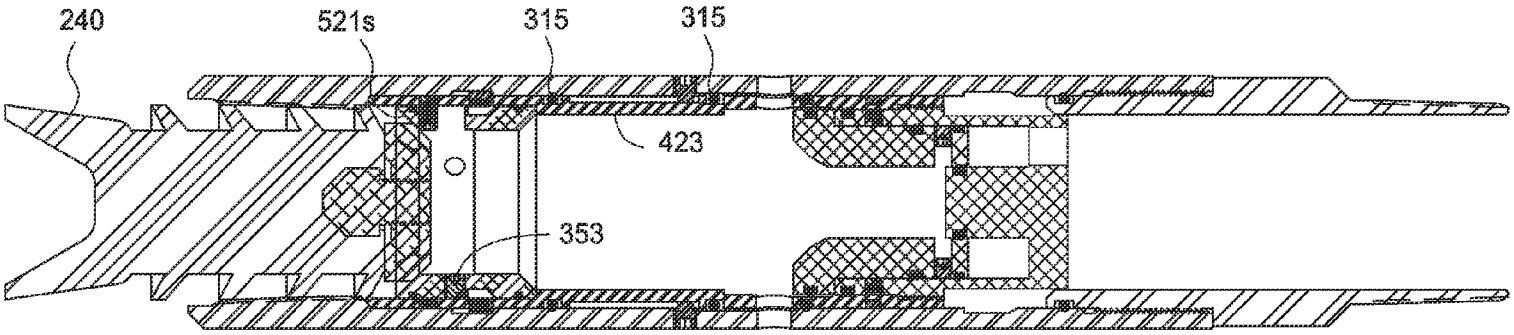
Figure 5D:
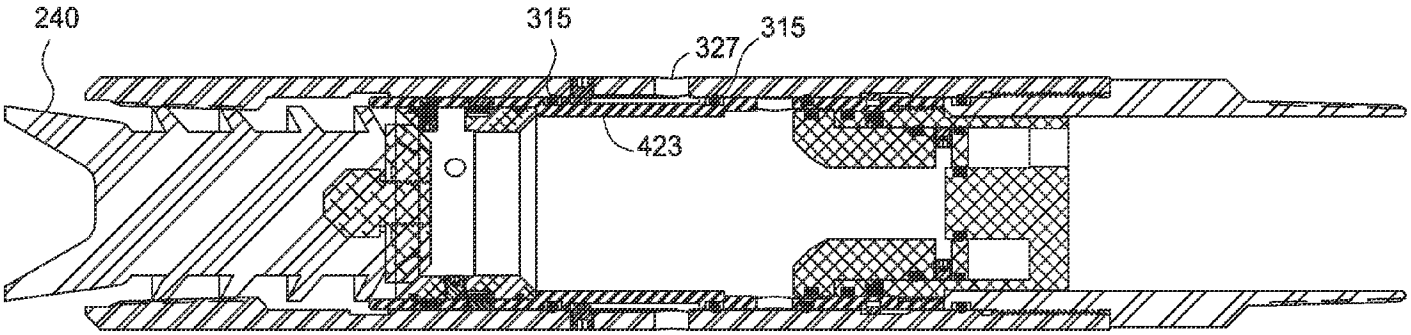

After a desired amount of fluid is displaced, such as cementing slurry, a wiper plug 240 is launched to engage the seat 521*s*, as explained above. Continued application of pressure results in shearing of shearable fasteners 353 and axial movement of the closing sleeve 423 to close and seal off the ports 327 using the seals 315, as shown in FIGS. 5C and 5D. The isolation mechanism 520 may then be drilled out to re-establish circulation to the bore.

FIGS. 6A-6D illustrate operation of a shifting tool 601 having an isolation mechanism 620, according to another embodiment of the disclosure. The shifting tool 601 is illustrated in a run-in-hole orientation in FIG. 6A. The shifting tool 601 includes a tubular body having a body 312 and a lower sub 311. It is contemplated that the tubular body may be single member, or formed from multiple members as shown. The isolation mechanism 620 is similar to the isolation mechanism 520. The isolation mechanism 620 includes a stud housing 661 and an opening sleeve 625. A central portion 625*c* of the opening sleeve 625 is surrounded by the stud housing 661. The stud housing 661 is spaced apart from the central portion 625*c* to facilitate fluid flow therebetween. The central portion 625*c* includes one or more ports 625*p* (one is shown) formed therein to facilitate fluid flow through the isolation mechanism 620 as shown by arrow 662 when the isolation mechanism 620 is in an open position, as illustrated.

Figure 6A:
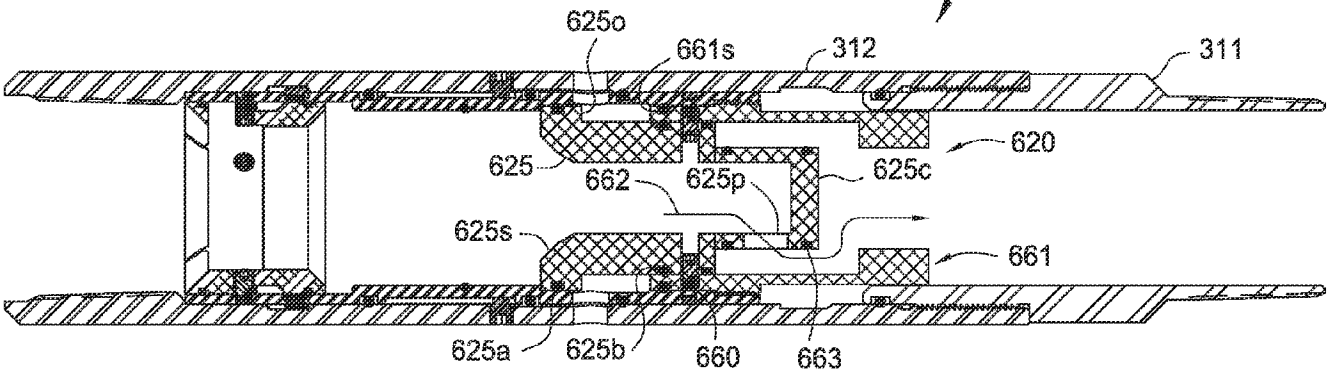
FIGS. 6A-6D illustrate operation of a shifting tool having an isolation mechanism, according to another embodiment of the disclosure.
Figure 6B:
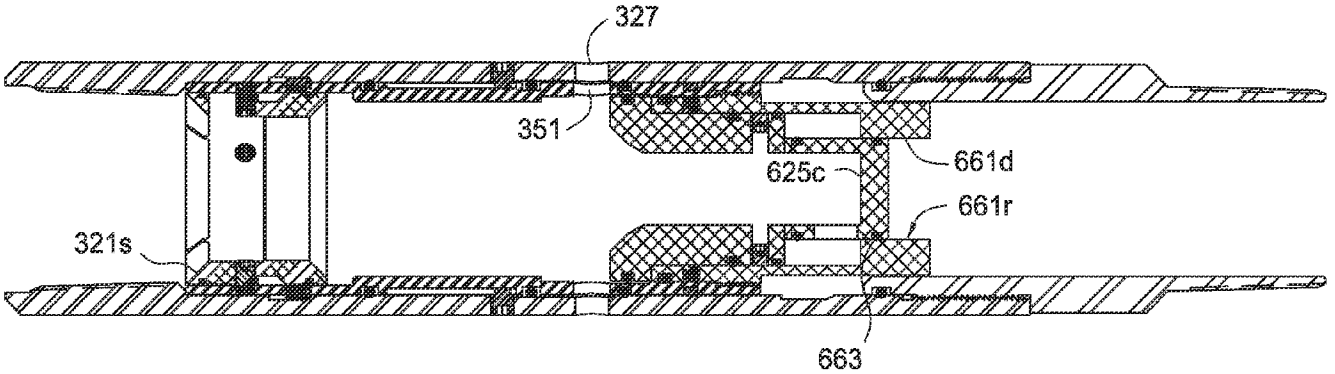

During operation, differential pressure applied to the seals 625*a,b* of the opening sleeve 625 results in movement of the opening sleeve. Once a threshold force on the seat 625*s* is reached, one or more shearable fasteners 660, which secure the opening sleeve 625 to the stud housing 661, shear to allow relative movement between the opening sleeve 625 and the stud housing 661. Shearing of the shearable fasteners 660 allows the opening sleeve 625 to move axially down hole relative to the stud housing 661 as a result of the differential pressure applied thereto until an outer shoulder 625*o* lands on a seat 661*s* disposed on the outward, upper portion of the stud housing 661, as shown in FIG. 6B. With the opening sleeve 625 shouldered out on the stud housing 661 due to the axial movement of the opening sleeve 625, the central portion 625*c* is urged into engagement with a sealing surface 661*d* of an inwardly-protruding ring 661*r* of the stud housing 661. The central portion 625*c* includes one or more seals 663, such as o-rings, disposed therearound to facilitate sealing between the central portion 625*c* and the inwardly-protruding ring 661*r* of the stud housing 661, thereby preventing fluid flow through the isolation mechanism 620 to down hole portions of the tubular 100*t* (shown in FIG. 1). Additionally, actuation of the opening sleeve 625 results in exposure/opening of the ports 327, 351 to facilitate cementing of up hole portions of an annulus between the tubular 100*t* and the wellbore.

Figure 6C:
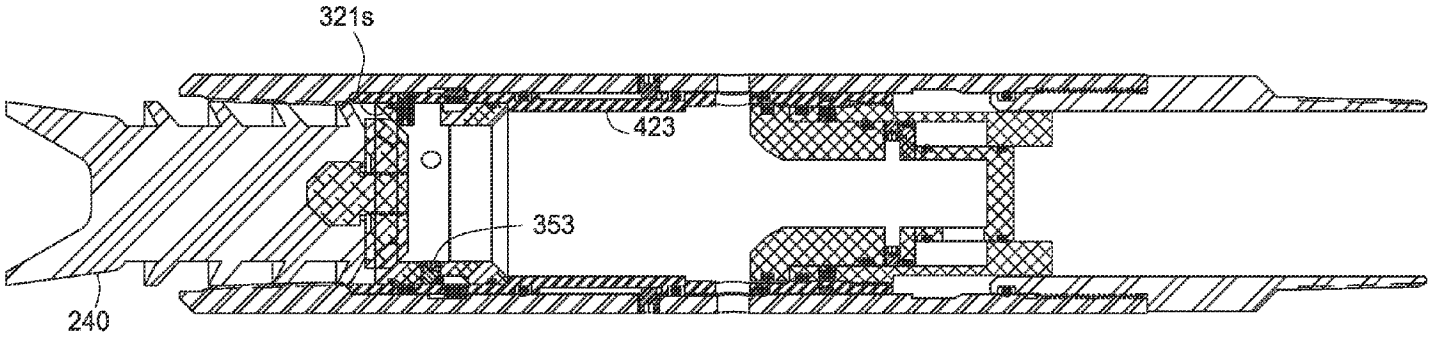
Figure 6D:
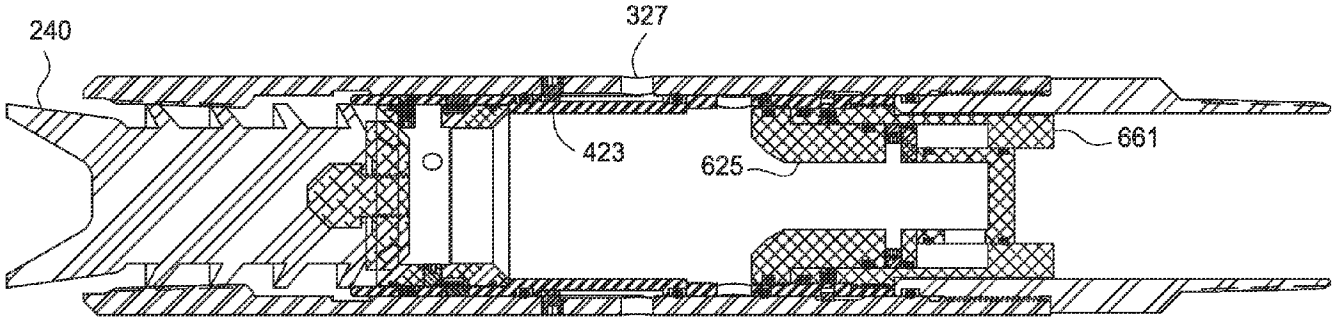

After a sufficient amount of cement has been pumped in to the tubular, a plug 240 is launched and propelled down hole via a chaser fluid, as shown in FIG. 6C and as described above. The plug 240 is seated on a seat 321*s*, and facilitates shifting of the closing sleeve 423 after shearing of shearable fasteners 353, as described above, to close and seal off the port 327. Shifting of the closing sleeve 425 also results in shifting of the opening sleeve 625 and the stud housing 661, as shown in FIG. 6D. The isolation mechanism 620 may then be drilled out to re-establish flow through the shifting tool 601.

FIGS. 7A-7D illustrate operation of a shifting tool 701 having an isolation mechanism 720, according to another embodiment of the disclosure. The isolation mechanism 720 is similar to embodiments described above; however, the isolation mechanism 720 includes an upward-shifting opening sleeve 725 rather than a downward shifting opening sleeve. The shifting tool 701 includes a tubular member having a top sub 210, a bottom sub 211, and a body 212 disposed therebetween and coupled thereto, for example, by a threaded connection. It is contemplated that the tubular body may be single member, or formed from multiple members as shown. The opening sleeve 725 is a tubular-shaped member coupled to a closing sleeve 723 by one or more shearable fasteners 725*f* (two are shown). A down hole portion 725*d* of the opening sleeve 725 is positioned, when in the run-in-hole orientation illustrated, to hold an inwardly-biased flapper 234 in an open position and prevent the inwardly-biased flapper 234 from closing. The flapper 234 may be biased using a spring, similar to embodiments described above. The down hole portion 725*d* may also be in contact with the hard seat 232.

Figure 7A:
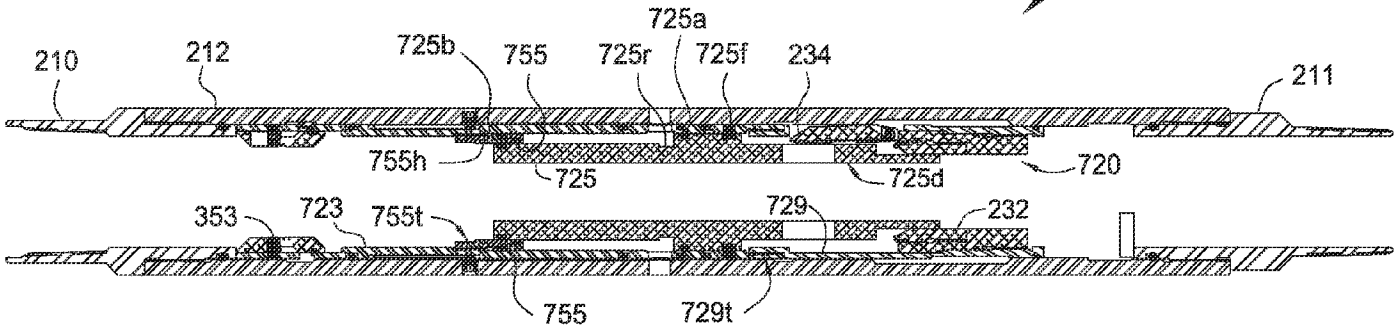
FIGS. 7A-7D illustrate operation of a shifting tool having an isolation mechanism, according to another embodiment of the disclosure.
Figure 7B:
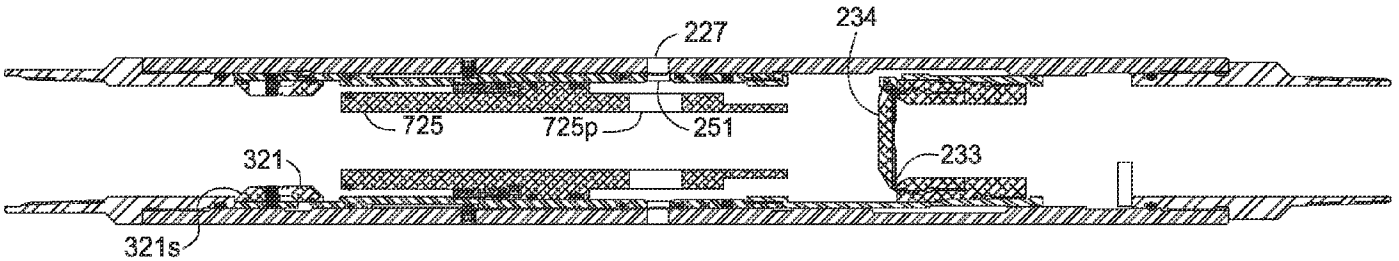

The opening sleeve 725 may be hydraulically shifted upward, as shown in FIG. 7B, by a differential pressure applied to the opening sleeve 725, or through use of a hydraulic motor (not shown). The inner diameter of the closing sleeve 723 up hole of a port 227 may be greater than the inner diameter of the closing sleeve 723 down hole of the port 227 to allow fluid to escape past seal 725*a* as the opening sleeve 725 is actuated, thus preventing hydraulic lock. In such an embodiment, the seal 725*a* may not seal against the closing sleeve 723 up hole of the port 227. Upward hydraulic actuation of the opening sleeve 725 may be facilitated by utilizing a larger diameter seal 725*a* below a smaller diameter seal 725*b*, thus creating upward net force in the presence of equal tubing pressure. FIG. 7B illustrates the opening sleeve 725 actuated axially up hole. As illustrated, the up hole positioning of the opening sleeve 725 removes the down hole portion 725*d* of the opening sleeve 725 from the travel path of the flapper 234, thereby allowing the inwardly-biased flapper 234 to close against the soft seat 233. Additionally, the up hole positioning of the opening sleeve 725 aligns one or more ports 725*p* (two are shown) formed through the opening sleeve 725 with the ports 227 and 251 to allow a cementing slurry to flow therethrough, facilitating a cementing process of up hole portions of the annulus surrounding the tubular 100*t* (shown in FIG. 1). When the opening sleeve 725 is shifted upward, one or more recesses 725*r* formed in an outer surface of the opening sleeve 725 are positioned adjacent an inwardly-biased retaining ring 755 (alternatively, inwardly biased dogs may also be used). The inwardly-biased retaining ring 755 is biased into the recess 725*r*, thereby coupling the opening sleeve 725 to a ring housing 755*h* threadedly coupled to a closing sleeve 723 by a threaded connection 755*t*.

Figure 7C:
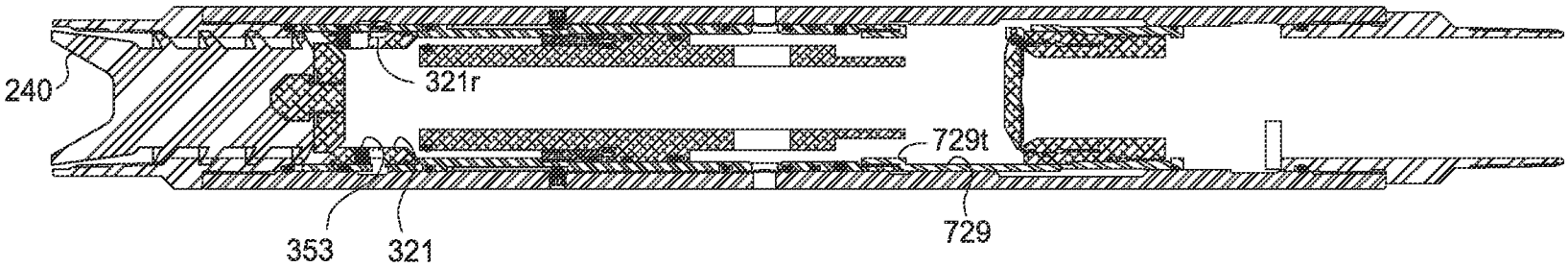

After a desired amount of cementing slurry has been pumped into the tubular 100*t*, a plug 240 may be launched down hole, as illustrated in FIG. 7C. The plug 240 may land in a seat 321*s* of the closing seat assembly 321. Increased downward pressure on the plug 240 as a result of chaser fluid pumped down hole results in shearing of shearable fasteners 353, as shown in FIG. 7C. Shearing of the shearable fasteners 353 allows axial movement of the closing seat assembly 321 as pressure is applied to the plug 240. As the closing seat assembly 321 moves axially down hole, one or more recesses 321*r* formed within an outer surface of the closing seat assembly 321 align with and receive inwardly-biased dogs 321*d*, thereby coupling the closing sleeve 723 and the closing seat assembly 321. Additional downward actuation of the closing seat assembly 321 also downwardly actuates the closing sleeve 723, the dog housing 755*h*, the opening sleeve 725, and a window sub 729. The window sub 729 may be coupled to the closing sleeve 723 by a threaded connection 729*t*.

Figure 7D:
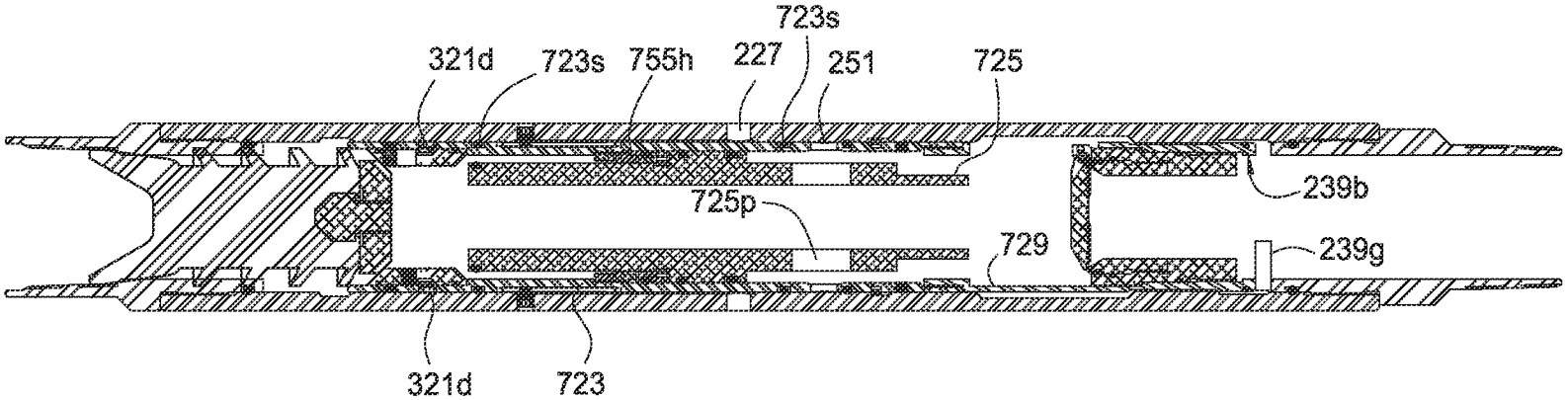

As illustrated in FIG. 7D, downward actuation of the closing sleeve 723 results in a misalignment of the ports 227 and 251, and one or more seals 723*s* on an outer surface of the closing sleeve 723 sealing over the port 227. The closing sleeve 723 may include one or more seals 723*s*, such as o-rings, disposed on an outer surface thereof to straddle the port 227 and to facilitate sealing of the port 227. Additionally, the axial actuation of the window sub 729 results in an anti-rotation sub 239*b*, e.g., a lower portion of the window sub 729, being positioned adjacent a mating profile 239*g*.

FIGS. 8A-8E illustrate operation of a shifting tool 801 having an isolation mechanism 820, according to another embodiment of the disclosure. The shifting tool 801 is similar to the shifting tool 201; however, the shifting tool 801 additionally includes one or more rupture disks 860, or burst tubes, sealing each port 227 when in the run-in-hole orientation illustrated in FIG. 8A. The shifting tool 801 includes a tubular member having a top sub 810, a bottom sub 811, and a body 812 disposed therebetween and coupled thereto, for example, by a threaded connection. It is contemplated that the tubular body may be single member, or formed from multiple members as shown. Actuation of the opening sleeve 225 and closing of the flapper 234 illustrated in FIG. 8B occur as described above with respect to FIG. 2B. However, the one or more ports 227 remains sealed due to the presence of the rupture disks 869 disposed thereover.

Figure 8A:
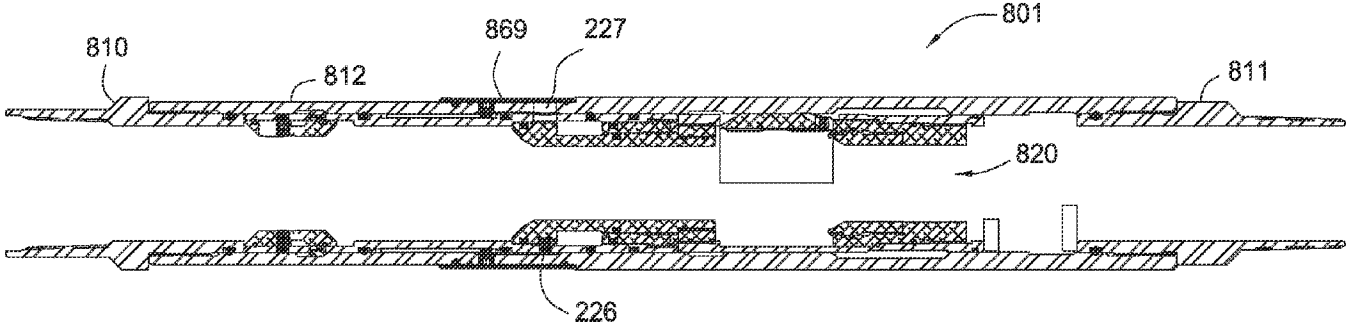
FIGS. 8A-8E illustrate operation of a shifting tool having an isolation mechanism, according to another embodiment of the disclosure.
Figure 8B:
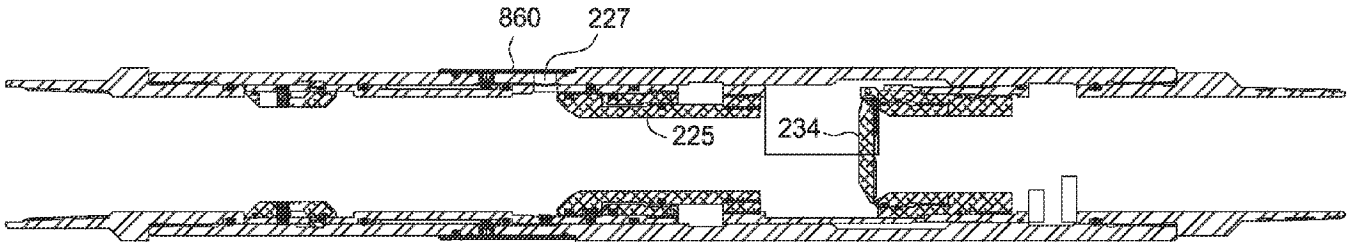
Figure 8C:
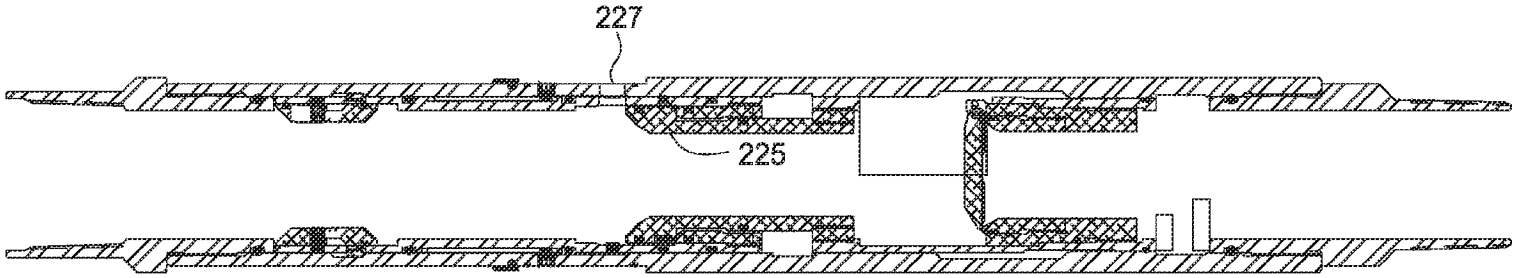
Figure 8D:
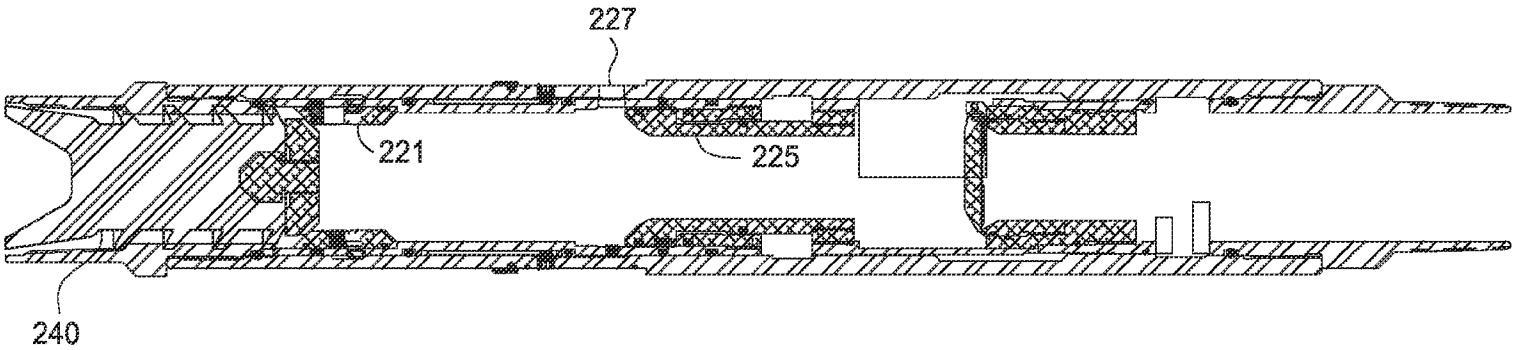
Figure 8E:
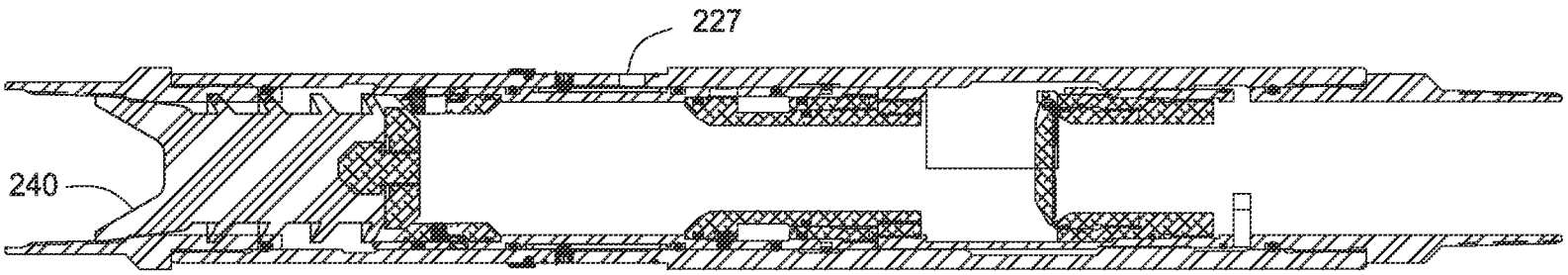

With the flapper 234 in the closed position, pressure within the shifting tool 801 may be increased by pumping fluids into the tubular 100*t* (shown in FIG. 1). When a second pressure threshold is reached, the one or more rupture disks 869 may rupture to open the ports 227, as shown in FIG. 8C. The second pressure threshold is generally greater than the pressure threshold of the shearable fasteners 226 that shear to release the opening sleeve 225. Thus, closing of the flapper 234 and opening of the ports 227 may occur in stages. FIGS. 8D and 8E illustrate pumping of a plug 240 and closing of the ports 227, as similarly described with respect to FIGS. 2C and 2D. The isolation mechanism may then be drilled to re-establish flow through the shifting tool 801, as shown in FIG. 2E.

Figure 9A:
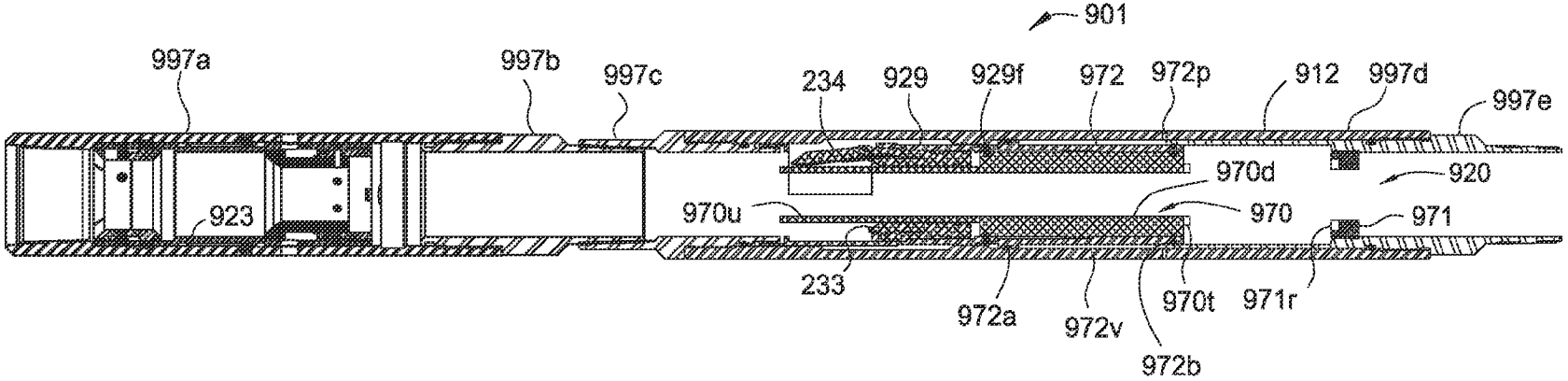
FIGS. 9A-9B illustrate operation of a shifting tool having an isolation mechanism, according to another embodiment of the disclosure.
Figure 9B:
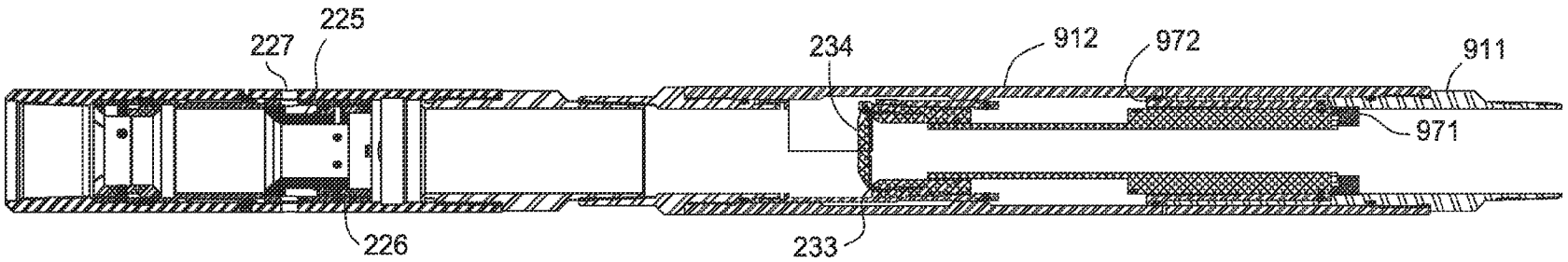

FIGS. 9A-9B illustrate operation of a shifting tool 901 having an isolation mechanism 920, according to another embodiment of the disclosure. The shifting tool 901 includes a tubular member having members 997*a-e*. It is contemplated that the tubular body may be single member, or formed from multiple members as shown. The isolation mechanism 920 includes a flapper shaft 970 having a down hole portion 970*d* coupled to a flapper shaft piston 972 and a window sub 929, and an up hole portion 970*u* adapted to hold an inwardly-biased flapper 234 in an open position. The flapper shaft 970 is coupled to the window sub 929 by a shearable fastener 929*f* that is adapted to shear when a first differential pressure threshold is applied to the seals 972*a,b*. The seals 972*a,b* are disposed on a radially outward surface of the flapper shaft piston 972. The seal 972*a* is disposed against the member 997*d*, while the seal 972*b* is disposed against the member 997*e*. Shearing of the fastener 929*f* releases the flapper shaft 970 from the window sub 929, thereby allow the flapper shaft 970 and the flapper shaft piston 972 to move axially relative to a body 912, as shown in FIG. 9B.

The flapper shaft 970 moves down hole and engages a shaft torque stop 971 having a recess 971*r* formed in an upper surface thereof for receiving a torque member 970*t* disposed on a lower surface of the down hole portion 970*d* of the flapper shaft 970. Engagement of the torque member 970*t* by the recess 971*r* prevents relative rotation therebetween. As the flapper shaft 970 moves downward, the flapper shaft piston 972 reduces a volume 972*v* located between a radially outward surface of the flapper shaft piston 972 and a radially inward surface of the body 912. Fluids located within the volume 972*v* escape through a port 972*p* to prevent hydraulic locking. As illustrated in FIG. 9B, the flapper shaft piston 972 may shoulder out on a surface of a bottom sub 911.

Axial movement of the flapper shaft 970 also results in clearance of the up hole portion 970*u* from the travel path of the inwardly biased flapper 234, thereby allowing the flapper 234 to close against the soft seat 233. Closure of the flapper 234 results in isolation of a down hole section of tubular 100*t* (shown in FIG. 1) from an up hole section of the tubular 100*t*. After closure of the flapper 234, pressure within the shifting tool 901 above the flapper 234 can be increased to a second pressure threshold, greater than the first pressure threshold, to shear fasteners 226 and axially move the opening sleeve 225 to open fluid communication through one or more ports 227. A cementing operation may then be performed, followed by a chaser plug to facilitate actuation of a closing sleeve 923 to close the one or more ports 227. A drilling operation may then be performed drill out the internal components of the shifting tool 901 to re-establish fluid flow through the shifting tool 901.

FIGS. 10A-10E illustrate operation of a shifting tool 1001 having an isolation mechanism 1020, according to another embodiment of the disclosure. The shifting tool 1001 includes a tubular body having an upper sub 1010, a body 1012, and lower sub 1011, which may be optionally integrally formed. The isolation mechanism 1020 includes a flapper shaft 1070 which is coupled by a shearable fastener 1070*f* to a flapper shaft retainer 1074. The flapper shaft retainer 1074 is a cylindrical member threadedly coupled to a radially inward surface of a bottom sub 1011. A seal 1074*s*, such as an o-ring, is disposed on a radially outward portion of the flapper shaft retainer 1074 to seal between the flapper shaft retainer 1074 and the bottom sub 1011. A seal 1070*s*, such as an o-ring, is disposed on a radially outward portion of the flapper shaft 1070 to seal between the flapper shaft 1070 and the flapper shaft retainer 1074. The flapper shaft 1070 also includes an increased diameter 1070*r* disposed therearound and in contact with a window sub 1029. The increased diameter 1070*r* includes a seal 1075 formed in a radially outward surface of the increased diameter 1070*r*. A differential pressure formed due to the different diameters of seals 1075 and 1070*s* facilitates actuation of the flapper shaft 1070 under applied pressure.

Figure 10A:
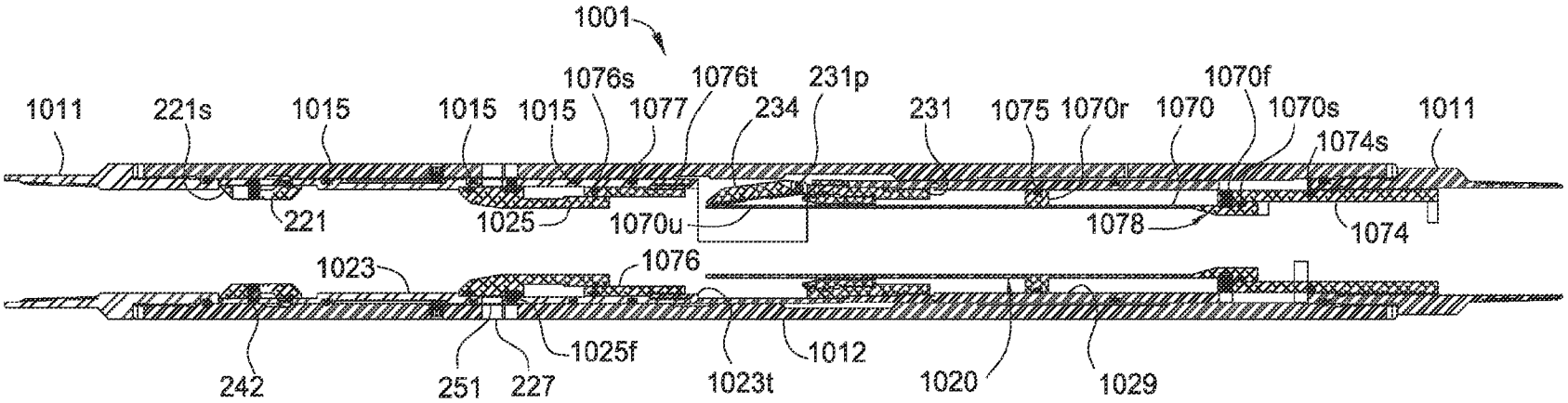
FIGS. 10A-10E illustrate operation of a shifting tool having an isolation mechanism, according to another embodiment of the disclosure.

An up hole portion 1070*u* of the flapper shaft 1070 is adapted to maintain an inwardly biased flapper 234 in an open position while the shifting tool 1001 is in the run-in-hole orientation illustrated in FIG. 10A. The flapper 234 is pivotably coupled to a flapper mount 231 by a pin 231*p* and biased by a spring 234*s* (shown in FIG. 2F). A closing sleeve 1023 is threadedly coupled to the window sub 1029 by a threaded connection 1023*t*. A sleeve stop 1076 is threadedly coupled to a radially inward surface of the closing sleeve 1023 by a threaded connection 1076*t*. A seal 1076*s*, such as an o-ring, is disposed between the radially outward surface of the sleeve stop 1076 and the radially inward surface of the closing sleeve 1023 to seal therebetween. A retaining ring 1077 may be positioned between a radially outward surface of the closing sleeve 1023 and a radially inward surface of a body 1012 to facilitate retaining of the closing sleeve 1023. One or more seals 1015 form a seal between the body 1012 and the closing sleeve 1023. One or more ports 227 (two are shown) through the body 212 is aligned with an equal number of ports 251 through the closing sleeve 1023 in the run-in-hole orientation. However, the ports 227 and 251 are sealed off, and flow is prevented therethrough, by one or more seals 1015 and an opening sleeve 1025 that is connected by a shearable fastener 1025*f* to the closing sleeve 1023.

Figure 10B:
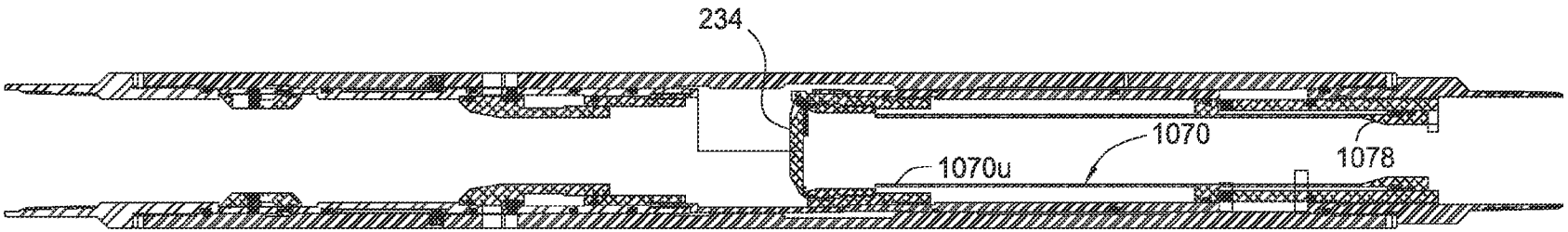
Figure 10C:
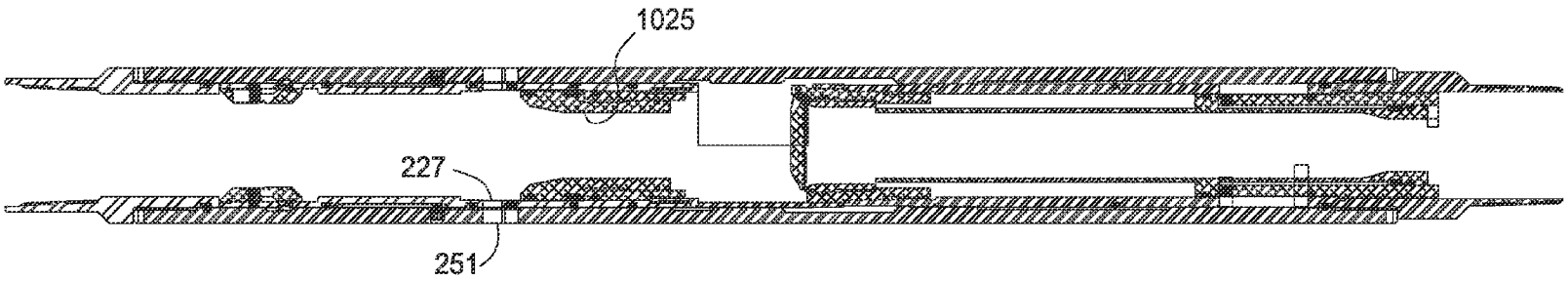

During operation, fluids pumped down hole form a pressure differential across seals 1075, 1070*s* of the flapper shaft 1070 to shear the shearable fastener 1070*f*. The flapper shaft 1070 is axially actuated to clear the up hole portion 1070*u* from the travel path of the flapper 234, thus allowing the flapper 234 to close, as shown in FIG. 10B. Subsequently, pressure within the shifting tool 1001 is increased until a pressure differential across the opening sleeve 1025 reaches a second predetermined pressure threshold, greater than the first predetermined pressure threshold, sufficient to shear the shearable fastener 1025*f*. Shearing of the shearable fastener 1025*f* allows the opening sleeve 1025 to axially move and open fluid communication through the ports 227 and 251 to facilitate fluid flow, such as a cementing slurry, therethrough. The exposed ports 227, 251 are illustrated in FIG. 10C. A section of the inner diameter of the closing sleeve 1023 located down hole of a port 227 may be greater than the inner diameter of a section of the closing sleeve 1023 up hole of the port 227 to allow fluid to escape past an up hole seal on the radially outward side of the opening sleeve 1025 as the opening sleeve 725 is actuated. Thus, the up hole seal of the opening sleeve 1025 seals against the closing sleeve 1023 when the opening sleeve 1025 is in an up hole or run-in position, but does not seal against the closing sleeve when in the actuated or down hole position. The escape of fluid prevents a hydraulic lock situation as the opening sleeve 1025 is actuated.

Figure 10D:
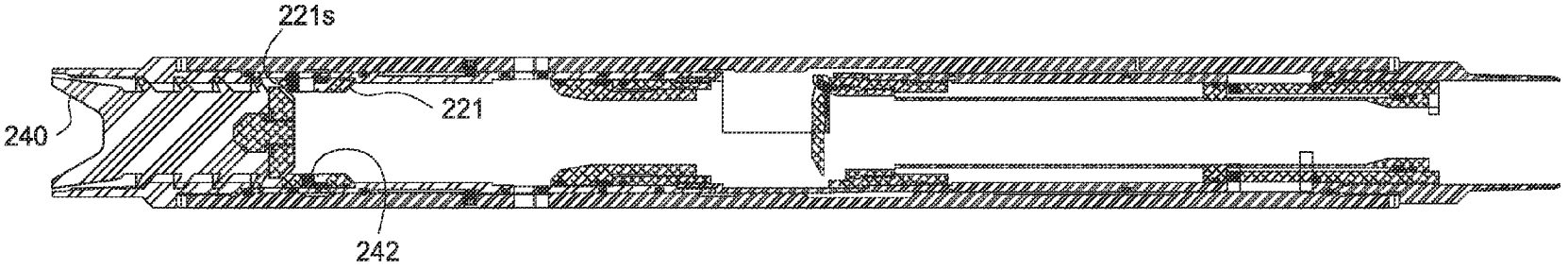
Figure 10E:
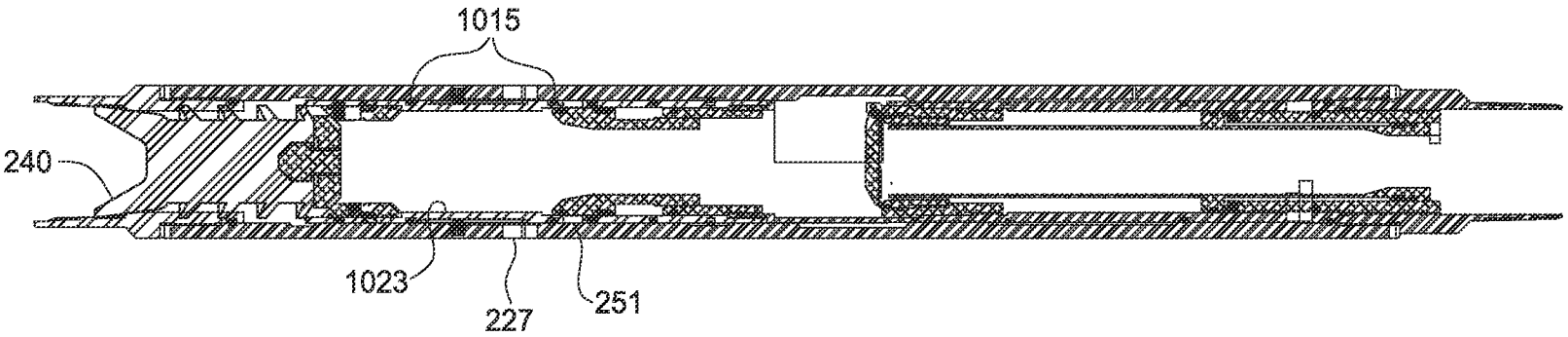

After a desired amount of cementing slurry has been pumped down hole, a plug 240 is launched thereafter. The plug 240 engages the seat 221*s* of a closing seat assembly 221, and continued downward pressure on the plug 240 (from a chaser fluid for example) results in shearing of a fastener 242, as shown in FIG. 10D. Shearing of the fastener 242 allows the closing sleeve 1023 to move down hole to close and seal off the port 227 by the seals 1015 on the closing sleeve 1023, as shown in FIG. 10. The isolation mechanism 1020 may then be drilled out to re-establish circulation through the shifting tool 1001.

Figure 11A:
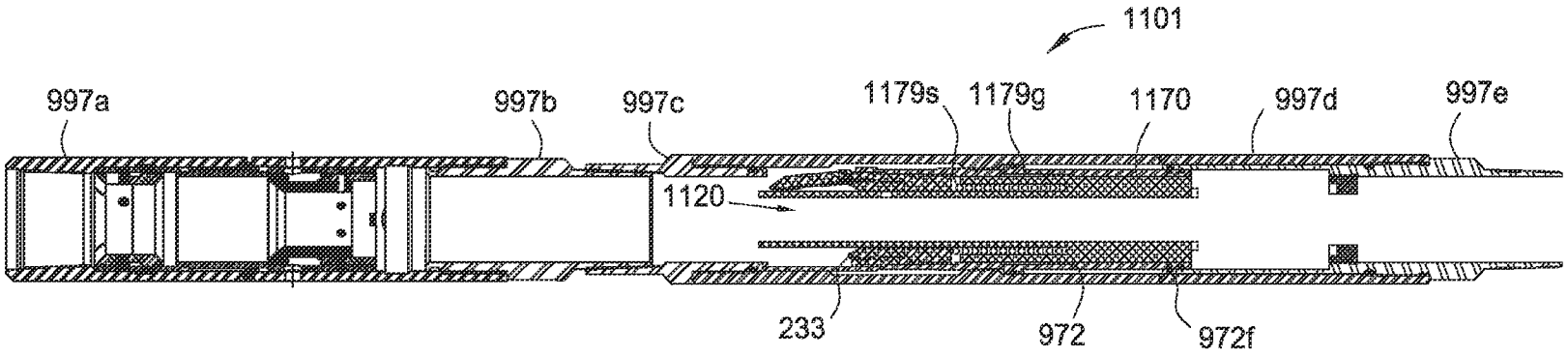
FIGS. 11A-11E illustrate operation of a shifting tool having an isolation mechanism, according to another embodiment of the disclosure.

FIGS. 11A-11E illustrate operation of a shifting tool 1101 having an isolation mechanism 1120, according to another embodiment of the disclosure. The shifting tool 1101 includes a tubular member having members 997*a-e*. It is contemplated that the tubular body may be single member, or formed from multiple members as shown. FIG. 11A illustrates the isolation mechanism 1120 in a run-in-hole orientation. The isolation mechanism 1120 is similar to the isolation mechanism 920, illustrated in FIGS. 9A-9B. However, the isolation mechanism 1120 includes a hydraulic lock compensation piston system 1179 to mitigate hydraulic locking that may occur during a port closing operation. The hydraulic lock compensation piston system 1179 includes a spring 1179*s* disposed in a recess or groove 1179*g* concentrically formed in a flapper shaft 1170. The groove 1179*g* is defined by an outer portion 1170*o* and an inner portion 1170*i* of the flapper shaft 1170.

Figure 11B:
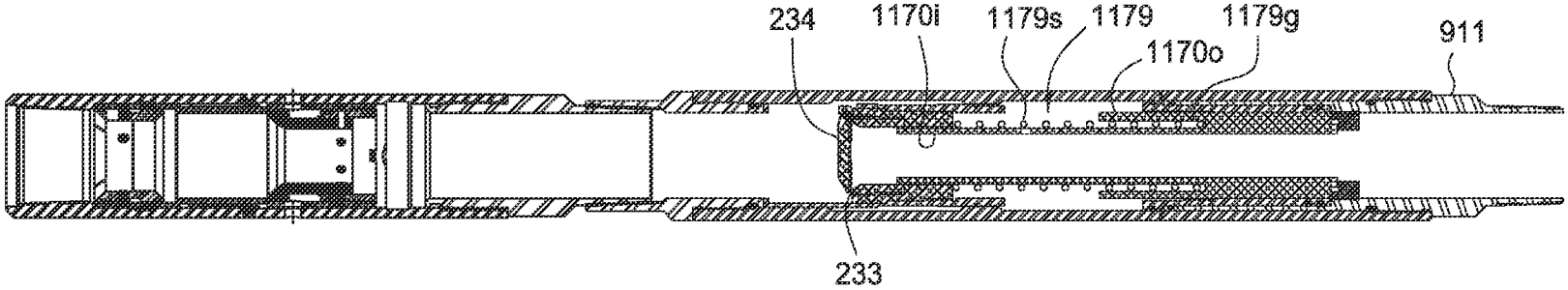

During operation, a pressure differential is applied across the flapper shaft 1170 until reaching a predetermined pressure threshold that is sufficient to shear a shearable fastener 972*f* that couples a flapper piston 972 to a lower sub 911. Shearing of the shearable fastener 972*f* permits the flapper piston 972, and the flapper shaft 1170 coupled thereto, to move in a down hole direction, as illustrated in FIG. 11B. The flapper piston 972 moves until shouldering out on the lower sub 911; however, in the shouldered out position, the spring 1179*s* remains partially compressed. Moreover, when the flapper piston 972 is in the shouldered out position, the inner portion 1170*i* of the flapper shaft 1170 is clear of the travel path of a flapper 234, thereby allowing the flapper 234 to close against a soft seat 233.

Figure 11C:
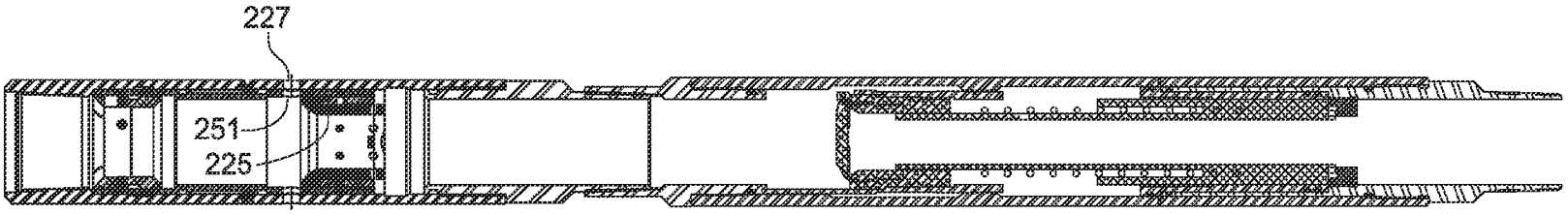
Figure 11D:
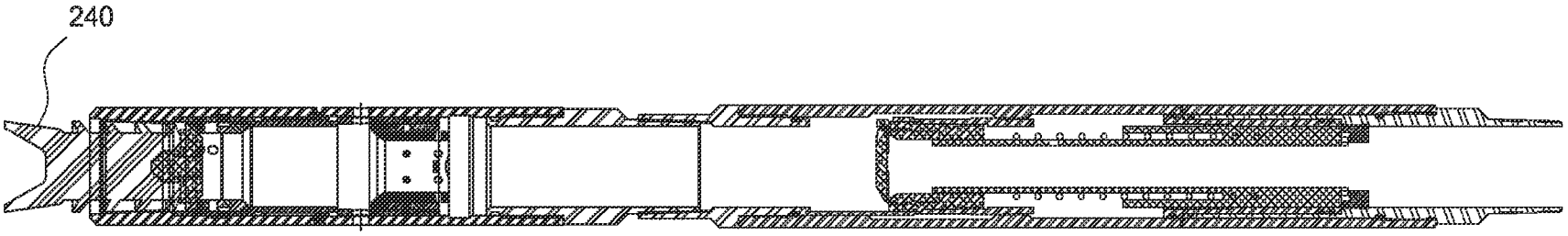
Figure 11E:
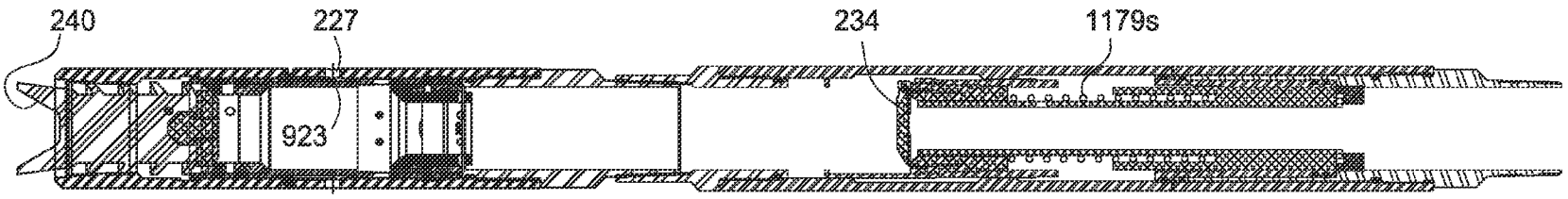

Subsequently, an opening sleeve 225 is actuated to expose ports 227 and 251, as shown in FIG. 11C and as similarly described above with respect to FIG. 2B. After a cementing operation is performed, a wiper plug 240 is launched, as shown in FIG. 11D. The wiper plug 240 facilitates actuation of a closing sleeve 923 to close the port 227, as shown in FIG. 11E. However, when the closing sleeve 923 moves to close off the port 227, a hydraulic lock can be created in the shifting tool 1101 between the wiper plug 240 and the flapper 234. The hydraulic lock occurs because an incompressible fluid is trapped within the shifting tool 1101 and cannot escape due to the closure of the port 227. A hydraulic lock formed within the shifting tool 1101 substantially prevents further down hole travel of the wiper plug 240. However, the hydraulic lock compensation piston system 1179 of the isolation mechanism 1120 allows for compensation of a hydraulic lock situation via the inclusion of a spring 1179*s* that can compress in response to an applied force. Thus, rather than resulting in a hydraulic lock situation, the spring 1179*s* compresses to accommodate a desired full range of travel of the wiper plug 240. After closure of the port 227, the isolation mechanism 1120 may then be drilled out to re-establish fluid flow through the shifting tool 1101.

Figure 12A:
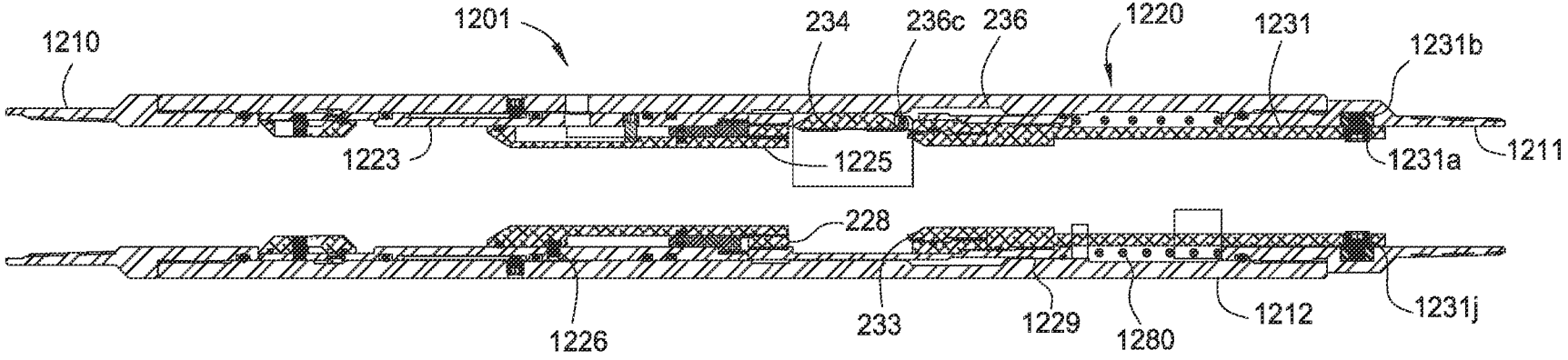
FIGS. 12A-12H illustrate operation of a shifting tool having an isolation mechanism, according to another embodiment of the disclosure.
Figure 12B:
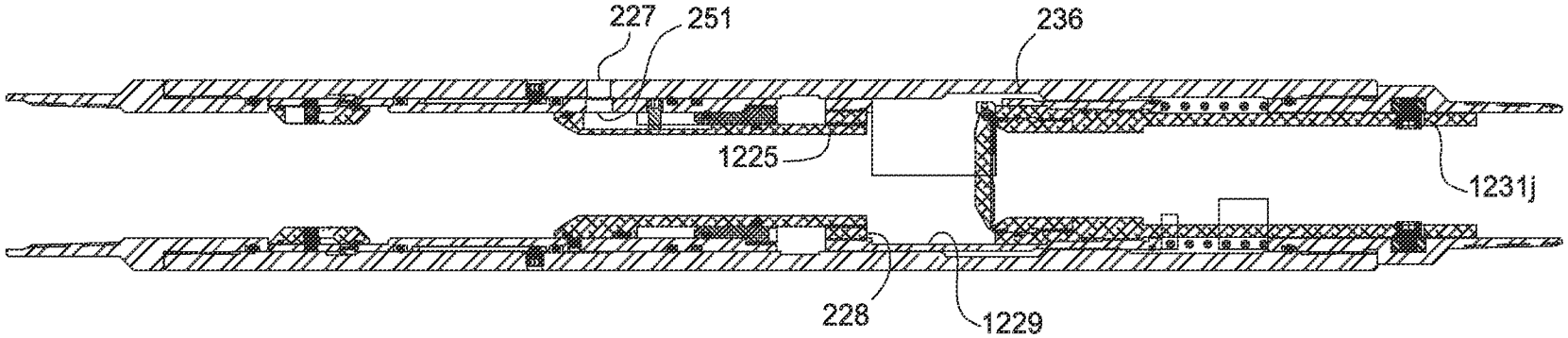
Figure 12C:
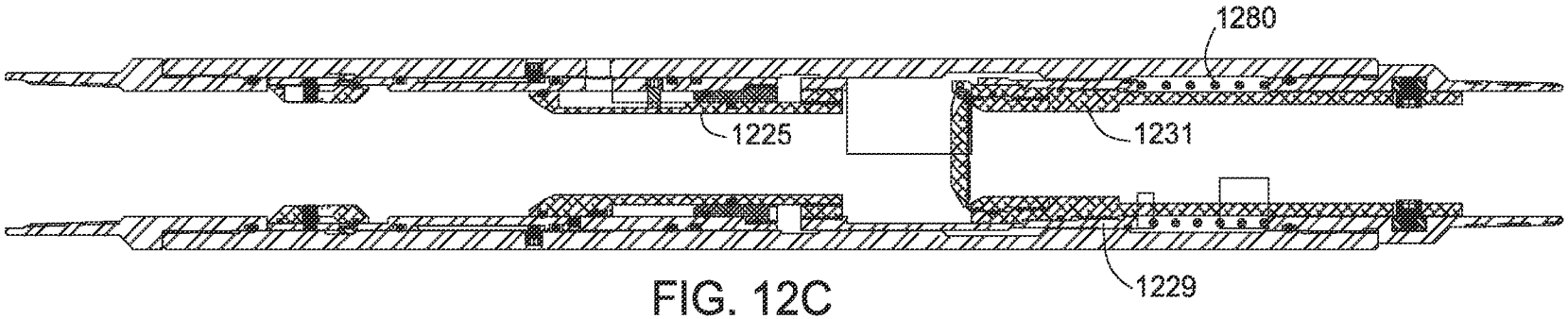
Figure 12D:
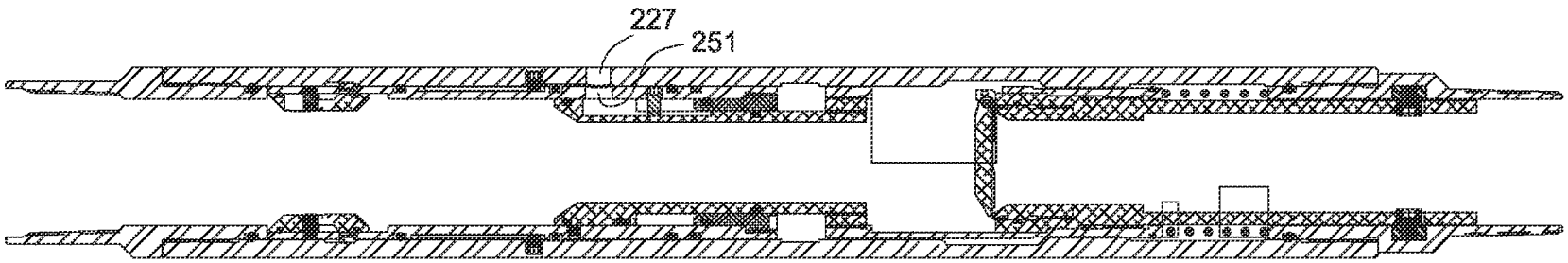
Figure 12E:
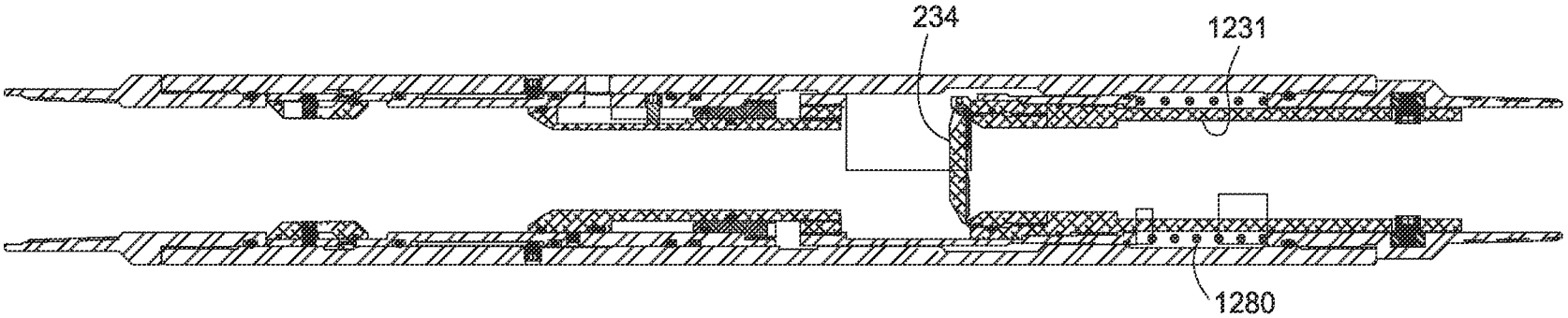
Figure 12F:
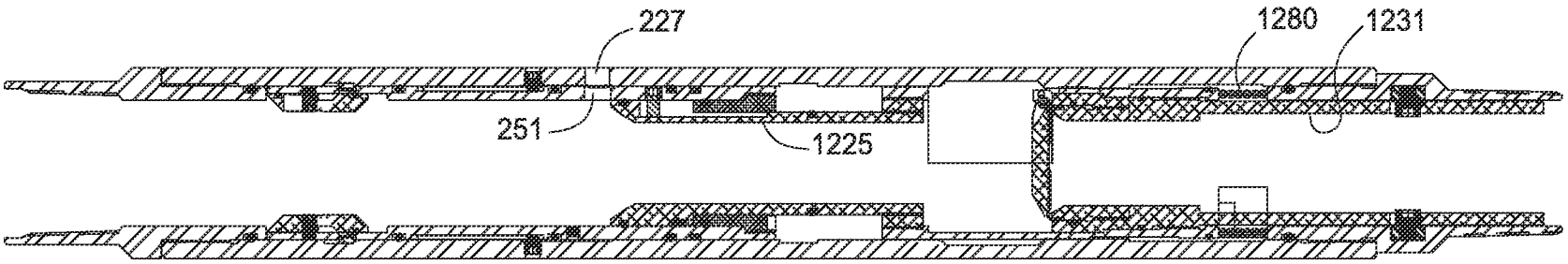
Figure 12G:
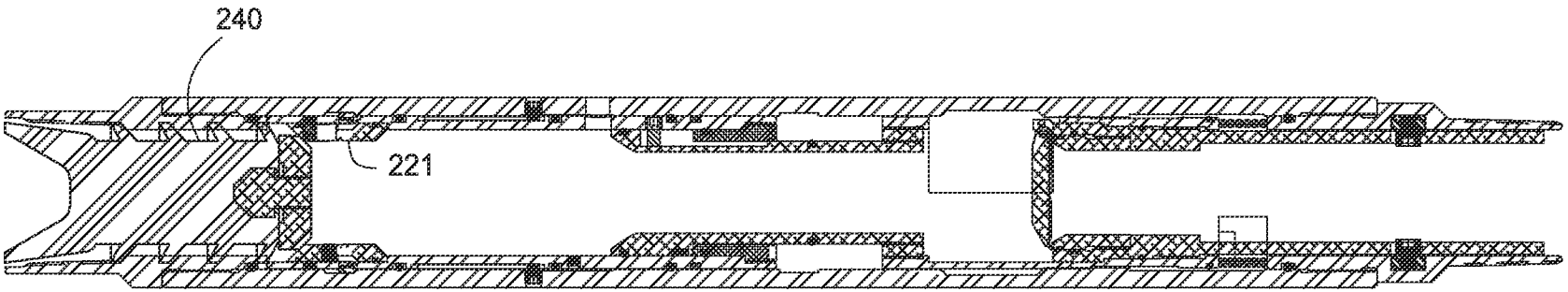
Figure 12H:
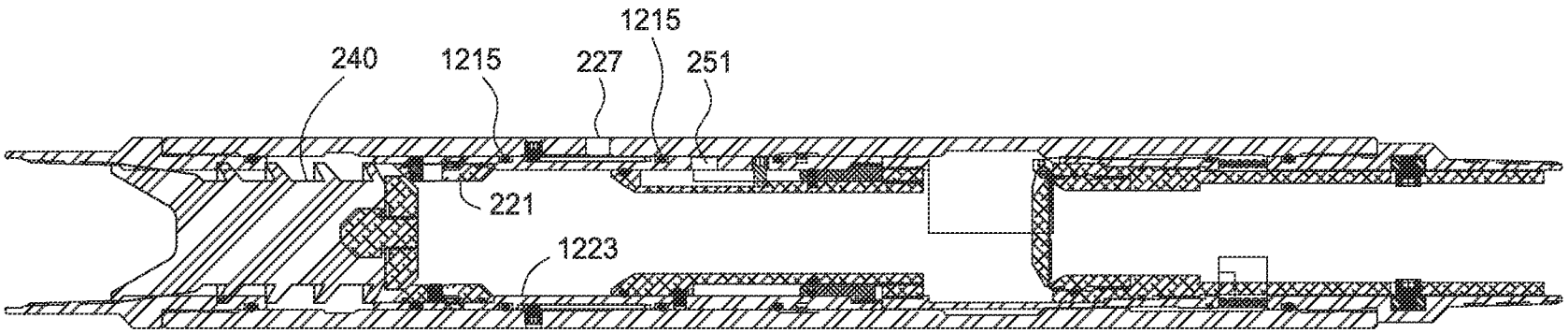
Figure 13:
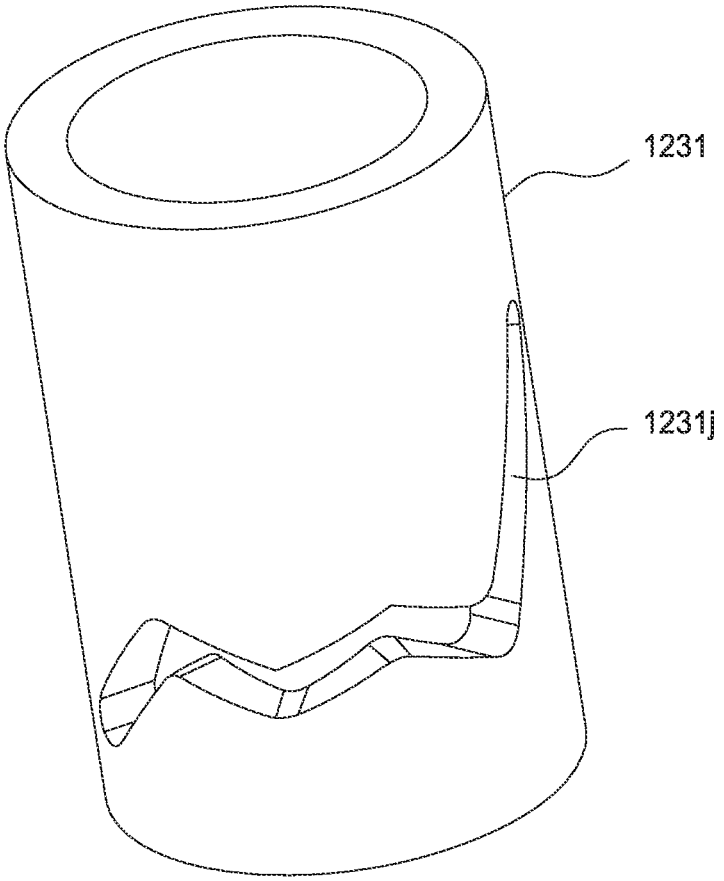
FIG. 13 illustrates a perspective view of a flapper mount, according to one embodiment of the disclosure.

FIGS. 12A-12H illustrate operation of a shifting tool 1201 having an isolation mechanism 1220, according to another embodiment of the disclosure. The shifting tool 1201 includes an upper sub 1210, a body 1212, and lower sub 1211, which may be optionally integrally formed. The isolation mechanism 1220 includes a flapper mount 1231 having a j-slot 1231*j* formed therein to test and confirm the actuation of a flapper. A perspective view of a flapper mount 1231 having the j-slot 1231*j* is illustrated in FIG. 13. One or more alignment screws 1231*a* (two are shown) each threaded into a bearing 1231*b* which is disposed within the j-slot 1231*j* and coupled to a lower sub 1211. On one example, the bearing 1231*b* may be disposed in a groove which goes entirely around the bottom sub 1211. A spring 1280 is compressed between an upper surface of the lower sub 1211 and a lower surface of a window sub 1229, while being housed between a body 1212 and the flapper mount 1231.

Figure 14:
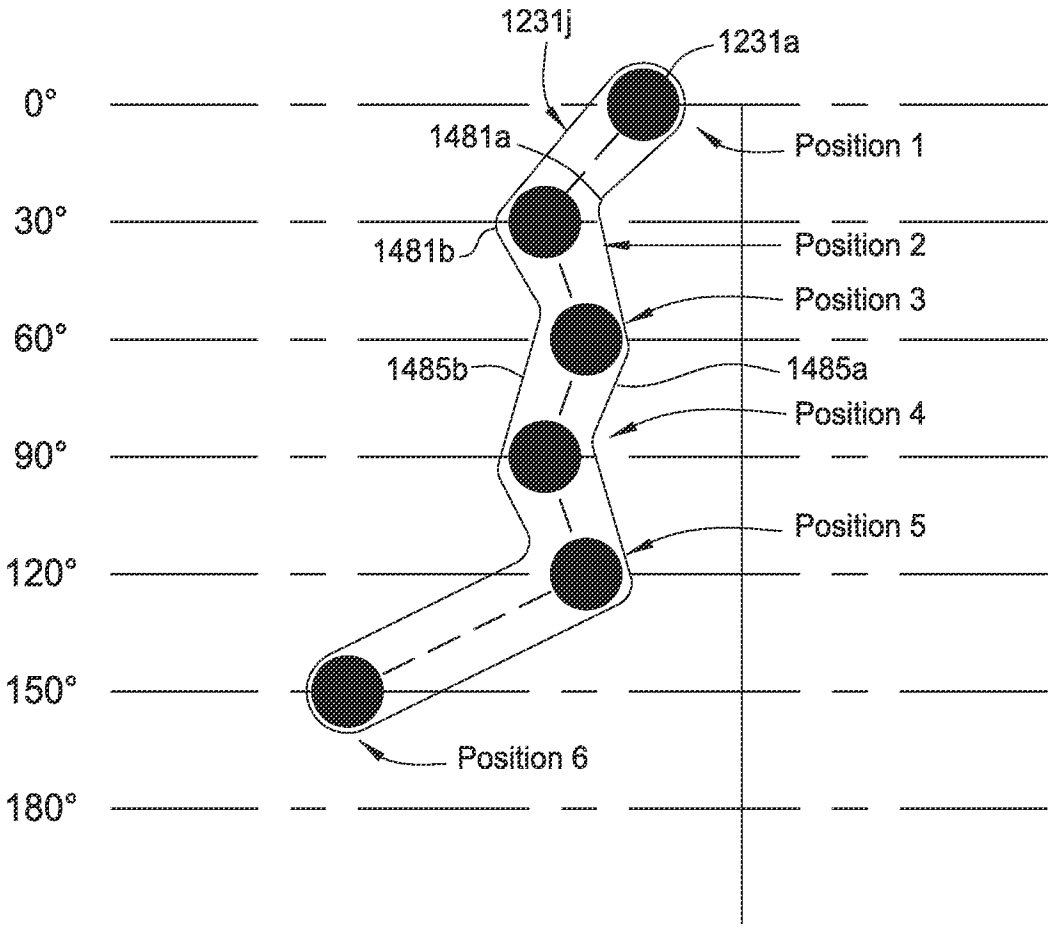
FIG. 14 illustrates a j-slot pattern for a j-slot of the flapper mount shown in FIG. 13, according to one embodiment of the disclosure.

During operation, a differential pressure is applied across an opening sleeve 1225 until a first pressure threshold sufficient to shear a shearable fastener 1226 is reached, at which time, the fastener 1226 coupling the opening sleeve 1225 to a closing sleeve 1223 shears. Shearing of the fastener 1226 allows axial movement of the opening sleeve 1225, as well as the window sub 1229 coupled thereto by an adapter 228, as shown in FIG. 12B. The flapper mount 1231 is coupled, for example by a threaded connection, to the window sub 1229, and thus, is moved with the opening sleeve 1225. The axial movement of the window sub 1229 compresses the spring 1280 and causes axial movement of the flapper mount 1231 relative to the alignment screw 1231*a* as guided by the j-slot 1231*j* and rotational motion of the bearing 1231*b* relative to the bottom sub 1211. It is contemplated that the bearing 1231*b* may be rotated relative to the opening sleeve 1225 to reduce seal damage. In one example, the rotational movement of the flapper mount 1231 may be about 30 degrees (e.g., from position 1 to position 2 as illustrated in FIG. 14). The axial movement of the flapper mount 1231 positions a pivoting connection 236*c* of the flapper 234 adjacent a recess 236 in the body 1212, thus allowing the flapper 234 to pivot into a closed position against a soft seat 233 due to bias applied by a spring. To confirm that the flapper 234 has closed, the number of pump strokes required to reach the first pressure threshold may be counted for later reference, as further explained below. It is to be noted that position 2 of the j-slot 1231*j* does not provide sufficient axial length of travel for the opening sleeve 1225 to expose the ports 227 and 251.

After reaching the first pressure threshold and closing the flapper 234, the pressure within the tubular 100*t* (as shown in FIG. 1) is bled off or reduced to a first pressure, such as atmospheric pressure or the pressure within the tubular 100*t* during a run-in-hole operation. As the pressure is reduced, the spring 1280 expands and moves the opening sleeve 1225, the window sub 1229, and the flapper mount 1231 upward, such that the flapper mount 1231 moves into the next position (e.g., position 3 illustrated in FIG. 14) of the j-slot 1231*j*, as illustrate in FIG. 12C. In one example, position 3 may be about 30 degrees from position 2.

Subsequently, the pressure within the tubular 100*t* may be increased again to the first pressure threshold, while counting the number of pump strokes required to reach the first pressure threshold or by some other measure of volume displaced into the tubular 100*t*, for example, measurement via a flow meter. The increase in pressure moves the flapper mount 1231, as shown in FIG. 12D, to a fourth position of the j-slot 1231*j*, as the alignment screw 1231*a* rides along the j-slot 1231*j*. It is to be noted that position 4 of the j-slot 1231*j* does not provide sufficient axial length of travel for the opening sleeve 1225 to expose the ports 227 and 251. Because the flapper 234 is closed and isolates a portion of the tubular 100*t*, e.g., effectively reducing the length of the tubular, the number of pump strokes required to reach the first pressure threshold should be less than the number of pump strokes initially required to reach the first pressure threshold. A reduced number of pump strokes confirms that the flapper 234 is in the closed position, while a substantially equal number of pump strokes indicates that the flapper 234 remains in an open position. After confirming that the flapper 234 is closed, the pressure within the tubular 100*t* may again be reduced to allow the spring 1280 to move the flapper mount 1231, shown in FIG. 12E, to position 5 of the j-slot 1231*j* (as illustrated in FIG. 14).

A subsequent pressure increase, for example due to a cementing slurry being pumped down hole, creates a pressure differential across the opening sleeve 1225 sufficient to move the flapper mount 1231 from position 5 to position 6 (as illustrated in FIG. 14) of the j-slot 1231*j*. As illustrated in FIG. 14, the axial range of travel of the flapper mount 1231 is greatest with respect to position 6. Position 6 is located to provide a sufficient range of motion of the opening sleeve 1225 to expose the ports 227, 251 while compressing the spring 1280 to a maximum compression. The continuous pressure of the cementing slurry is sufficient to force the opening sleeve 1225 against the bias of the spring 1280 to keep the ports 227, 251 exposed; however, it is contemplated that a ratchet or similar device may be utilized to maintain the flapper mount in position 6 of the j-slot 1231*j*. If cementing pressure is lost, the j-slot will revert to position 5, closing the ports. Reapplication of pressure will return the j-slot to position 6, effectively opening the ports again. This may be repeated as many times as desired. The geometry of the j-slot prevents going from position 5 back to position 4 (as explained with respect to FIG. 14).

After a sufficient amount of cementing slurry has been pumped into the tubular 100*t*, a wiper plug 240 may be launched into the tubular 100*t*. The wiper plug 240 may engage a closing seat assembly 221, as shown in FIG. 12G, facilitating actuation of the closing sleeve 1223. Actuation of the closing sleeve 1223 results in misalignment of the ports 227, 251, as shown in FIG. 12H, and moves one or more seals 1215 on the closing sleeve 1223 to seal off fluid flow through the ports 227. The isolation mechanism 1220, or parts thereof, may then be drilled out to re-establish flow through the shifting tool 1201.

FIG. 14 illustrates a j-slot pattern for the j-slot 1231*j* of the flapper mount 1231 shown in FIG. 13, according to one embodiment of the disclosure. The j-slot pattern includes six positions, however, it is contemplated that less positions may be included if flapper closure confirmation is undesired. Each of the six positions are positioned in 30 degree intervals from one another, but it is contemplated that the positions may be spaced further or closer to one another. Additionally, while the illustrated pattern includes only a single j-slot, it is contemplated that the flapper mount may include more than one j-slot. For example, the flapper mount may include two j-slots positioned about 180 degrees from one another; however, only a single j-slot 1231*j* is illustrated for clarity purposes.

Each of positions 2-5 include off-set peaks formed in opposing sides of the j-slot to facilitate one-directional travel of the flapper mount 1231 relative to the alignment screw 1231*a*, thus avoiding unintentional rotation of the flapper mount 1231 in an undesired direction. For example, referring to position 2, a first side 1485*a* of the j-slot 1231*j* includes a peak 1481*a* formed therein which is positioned closer to position 1 than a peak 1481*b* formed in a second side 1485*b*. Thus, when the alignment screw 1231*a* is resting in position 2, axial movement of the flapper mount 1231 relative thereto results in the alignment screw 1231*a* contacting the first side 1485*a* on a side of the peak 1481*a* closer to position 3, which forces and guides the flapper mount 1231 to rotate to position 3 rather than returning to position 1. Similarly, an off-set peak at position 3 forces and guides the flapper mount 1231 to rotate to position 4, while an off-set position at 4 forces and guides the flapper mount 1231 to rotate to position 5. Position 5 includes a similar off-set peak to facilitate one-directional rotation to position 6. As described above, position 6 allows the greatest axial range of motion of the opening sleeve 1225 relative to any of the other positions in the j-slot 1231*j*, thereby allowing one or more ports (e.g., ports 327 and 352 shown in FIG. 12F) to be exposed when the alignment screw 1231*a* is in position 6.

Figure 15:
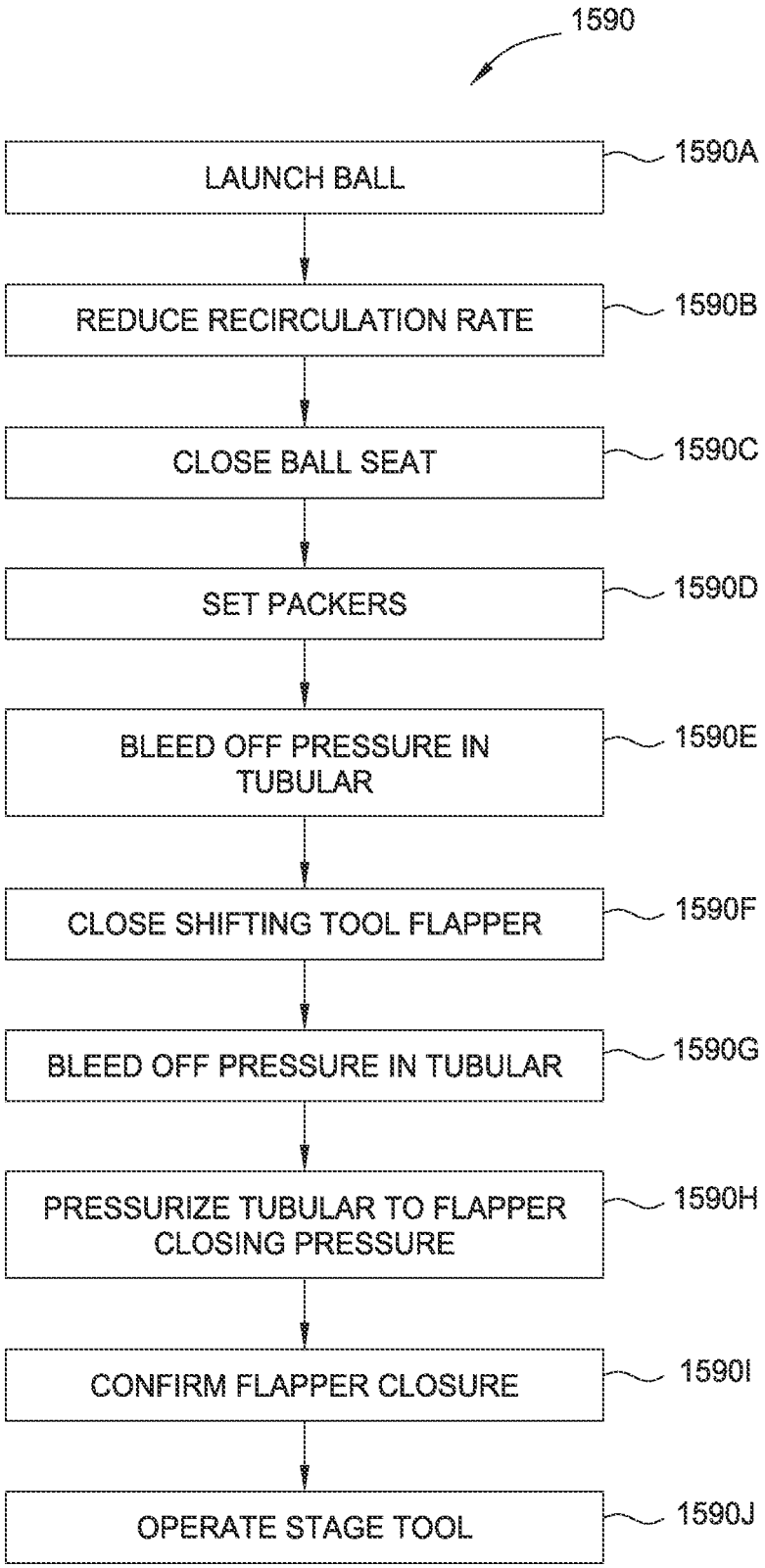
FIG. 15 illustrates a flow diagram of a method of verifying flapper closure, according to one embodiment of the disclosure.

FIG. 15 illustrates a flow diagram 1590 of a method of verifying flapper closure, according to one embodiment of the disclosure. The flow diagram 1590 begins at operation 1590A which occurs after running a shifting tool into a wellbore and circulating fluid therethrough as desired. In operation 1590A, a plug or ball is a launched from a ball launcher and subsequently received in a ball seat, such as ball seat 107 shown in FIG. 1. The plug or ball may be launched using a first fluid flow or recirculation rate, such as about 1.0 cubic meter per minute. In operation 1590B, the recirculation rate is reduced to a second rate less than the first rate, for example, to about 0.1 cubic meters per minute. The recirculation rate may be reduced when the plug or ball is a predetermined time or distance, which may be estimated, from the ball seat. In one example, the recirculation rate may be reduced when the plug or ball is about 5 minutes from the ball seat. The reduction in recirculation rate reduces the likelihood of unintentional shearing of shearable fasteners due to a rapid pressure increase upon seating of the plug or ball.

In operation 1590C, with the plug or ball seated in the ball seat, the pressure within the tubular is increased to a threshold pressure sufficient to shear fasteners within the ball seat, thus closing the ball seat. In one example, the ball seat may close at a pressure of about 2000 psi. In operation 1590D, the pressure within the tubular is further increased to set one or more packers, such as packers 103*a,b,c,d*. In operation 1590E, pressure within the tubular 100*t* is reduced, e.g., bled off, to atmospheric pressure at surface. In operation 1590F, a flapper of a shifting tool is closed by pumping up to a threshold pressure sufficient actuate the shifting tool to close the flapper, as discussed above. During operation 1590F, the volume of fluid required to reach the threshold pressure to close the flapper is measured, such as by counting the number of pump strokes required, or by measurement via flow meter.

In operation 1590G, after closure of the flapper, the pressure within the tubular is again bled off. In one example, the pressure is reduced to the same level as in operation 1590E. In operation 1590H, the pressure within the tubular 100*t* is again increased to the first threshold pressure, e.g., the pressure required to close the flapper, while measuring the volume required to reach the threshold pressure. In operation 1590I, flapper closure is confirmed by comparing the volume determined in operation 1590F to the volume determined in operation 1590I. Because the tubular 100*t* is pressurized from the toe thereof (e.g., from the ball seat 107) when closing the flapper in operation 1590F, the volume in operation 1590F should be greater than the volume in operation 1590I, which pressurizes a smaller section of the tubular (e.g., from the flapper to the pump). Thus, by comparing the volume utilized to reach a threshold pressure, flapper closure can be confirmed. If, however, the volume used to reach the threshold pressure in operation 1590I is approximately equal to the volume used in operation 1590F, this is indicative of flapper closure failure. In operation 1590J, a stage tool is operated as described above. This may include immediately proceeding to shear fasteners within the stage tool to expose a port, or, it is contemplated that a pressure increase incurred in operation 1590J may first be bled off before shearing fasteners within a stage tool.

FIGS. 16A-16E illustrate operation of a shifting tool 1601 having an isolation mechanism 1620, according to another embodiment of the disclosure. The shifting tool 1601 includes a tubular body having an upper sub 1610, a body 1612, and lower sub 1611, which may be optionally integrally formed. The isolation mechanism 1620 includes a flapper 234 coupled to a flapper mount 231. The flapper mount 231 is coupled to a window sub 229. The flapper 234, which is biased towards a closed position, is maintained in an open position in a run-in-hole orientation by an extending member 1694*e* of a flapper release sleeve 1694 that interferes with the travel path of the flapper 234. The flapper release sleeve 1694 is positioned radially inward of a sleeve retainer 224. During operations, a pressure differential that results due to the difference in sizes of the seals 1694*a,b* facilities shearing of a shearable fastener 1694*f* and axial actuation of the flapper release sleeve 1694. The flapper release sleeve 1694 actuates upward until contacting a surface of the opening sleeve 1625.

Figure 16A:
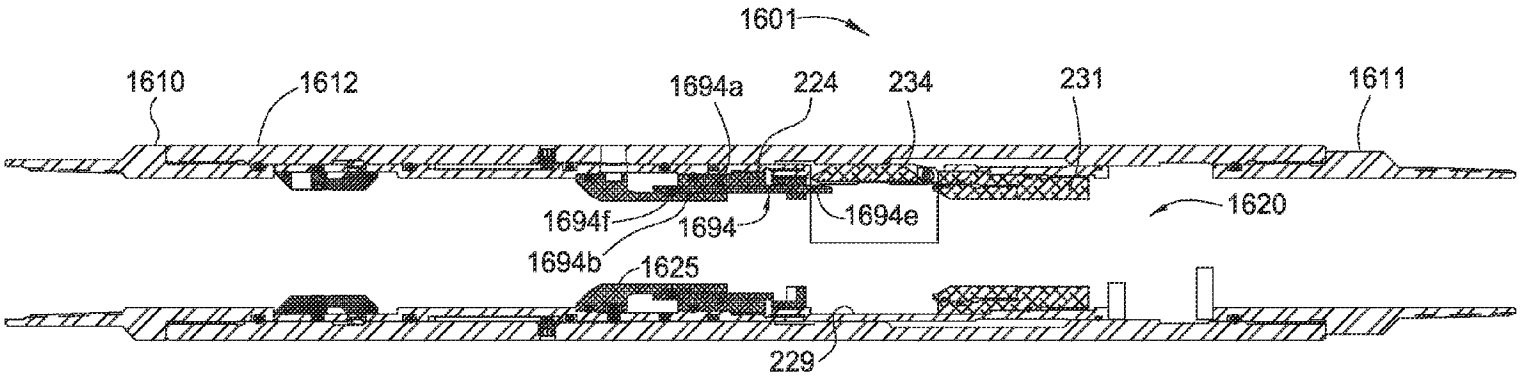
FIGS. 16A-16E illustrate operation of a shifting tool having an isolation mechanism, according to another embodiment of the disclosure.
Figure 16B:
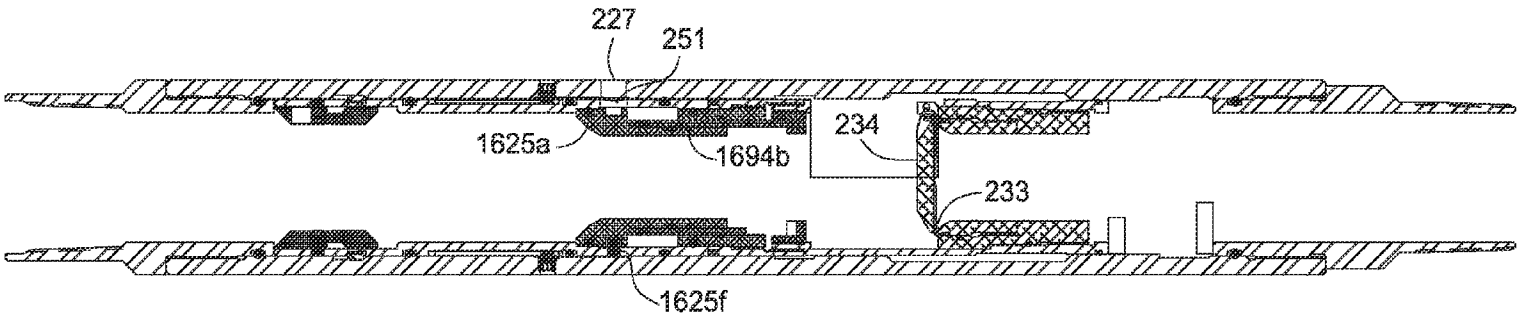
Figure 16C:
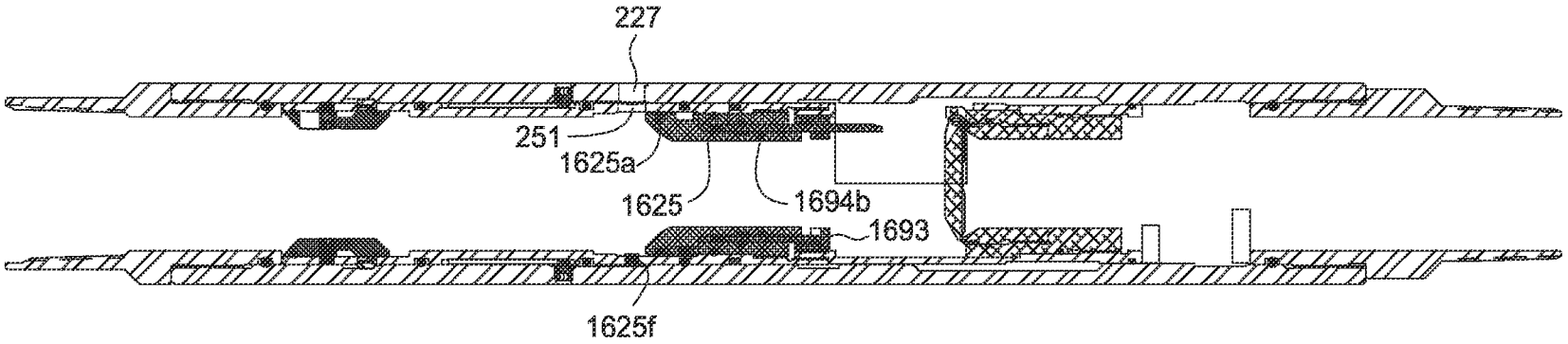

As illustrated in FIG. 16B, upward actuation of the flapper release sleeve allows the flapper 234 to pivot into a closed position against a soft seat 233. Pumping of additional fluids down hole results in a second pressure differential being applied to seals 1625*a*, 1694*b* of the opening sleeve 1625 until shearing of the shearable fastener 1625*f* results. Upon shearing of the shearable fastener 1625*f*, the opening sleeve 1625 axially actuates to allow fluid flow through the aligned ports 227, 251, as shown in FIG. 16C. The opening sleeve 1625 may be actuated into contact with an upper surface of the sleeve retainer 224, resulting in contact between a lower surface of the flapper release sleeve 1694 and a stop member 1693. The stopper member 1693 is coupled to a radially inward side of the window sub 229. It is to be noted that the stop member 1693 may have a passage formed therein to allow the extending member 1694*e* to be disposed therethrough. A cementing operation may then be performed.

Figure 16D:
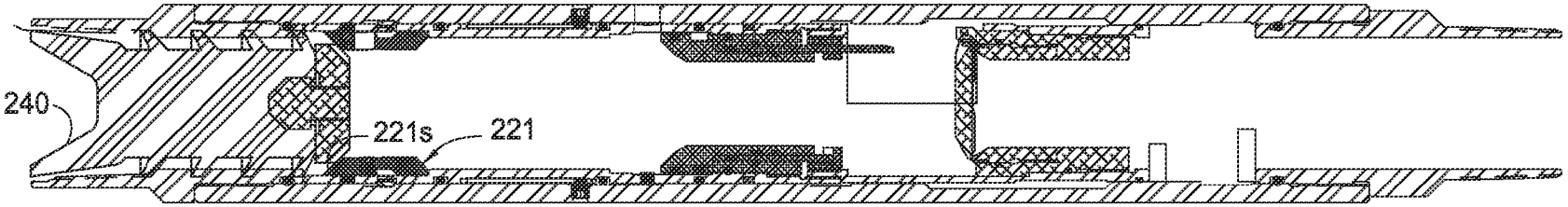
Figure 16E:
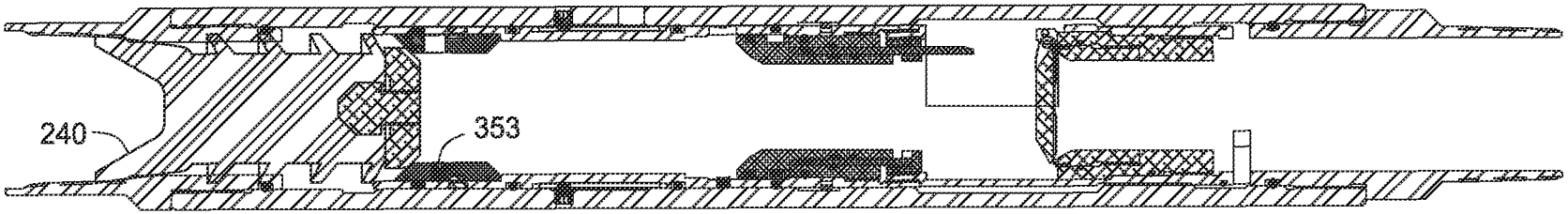

After a desired amount of cementing slurry has been pumped down hole, a plug 240 may be launched. The plug 240 engages a seat 221*s* of the closing seat assembly 221, as shown in FIG. 16D. Additional pressure applied to the plug 240 results in shearing of the shearable fastener 353, actuation of the closing seat assembly 221, and actuation of the closing sleeve 223 to seal the port 227, as similarly described above with respect to FIGS. 2C-2D.

FIGS. 17A-17F illustrate operation of a shifting tool 1701 having an isolation mechanism 1720, according to another embodiment of the disclosure. The shifting tool 1701 is similar to the shifting tool 201 illustrated in FIGS. 2A-2E, however, the shifting tool 1701 uses a rotating ball valve assembly 1730 to restrict flow through the shifting tool 1701 as opposed to a flapper seal assembly 230.

The isolation mechanism 1720 includes the ball valve assembly 1730, the window sub 1729, and the opening sleeve 225. The ball valve assembly 1730 is coupled to a window sub 1729 using a plurality of pins 1780 disposed in a groove 1781 (shown in FIGS. 17D-17F) formed in the outer surface of the ball seal 1782. The ball valve 1782 is a ball or partial ball shape with an opening 1783 defined therethrough along a central axis, and may be formed, for example, from a plastic or other phenolic material. The ball valve 1782 may be axially elongated to increase the surface area of the ball valve 1782 in contact with the inner surface of the window sub 1729 to increase sealing therebetween. The ball valve 1782 is supported by a ball seat 1784 at a lower end thereof.

Figure 17A:
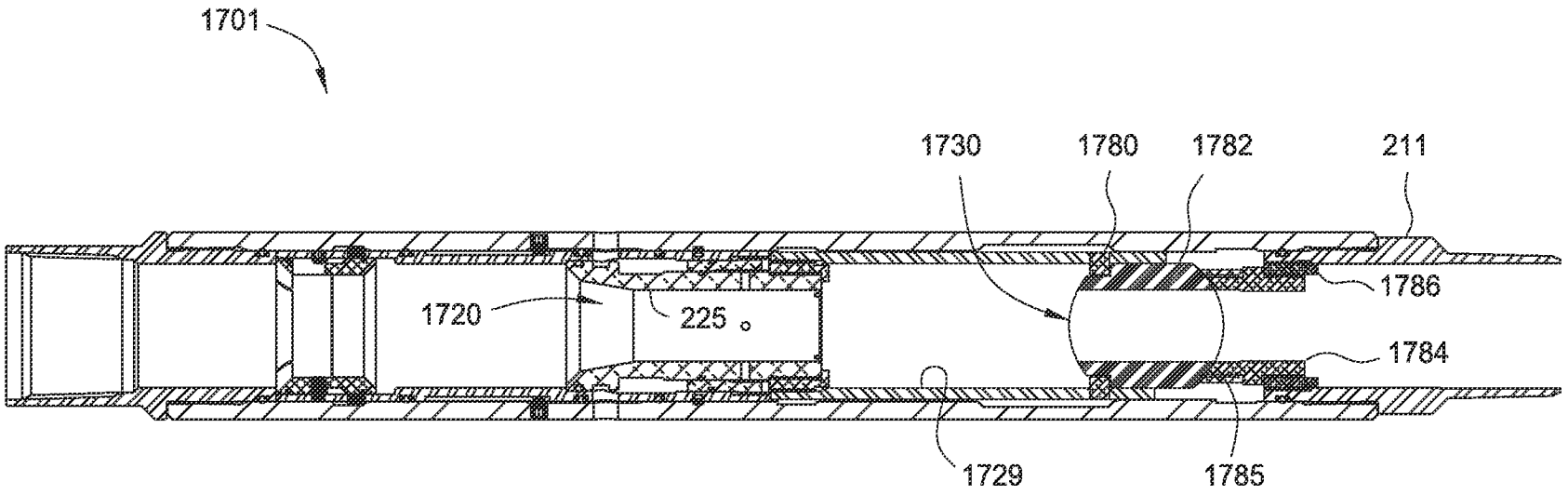
FIGS. 17A-17F illustrate operation of a shifting tool having an isolation mechanism, according to another embodiment of the disclosure.

A seal 1785 is disposed on the radially outward upper end of the ball seat 1784 to contact a lower surface of the ball valve 1782 and form a fluid tight seal therebetween. The ball seat 1784 is coupled to the radially-inward surface of the lower sub 211 through a threaded adapter 1786. The threaded adapted 1786 is disposed at the upper end of the lower sub 211. As illustrated in FIG. 17A, the ball valve 1782 of the ball valve assembly 1730 is oriented so that the opening 1783 is axially aligned with the bore of the shifting tool 1701, thereby permitting the flow of fluid therethrough. FIG. 17D illustrates a side perspective view of the ball valve 1782. FIG. 17E illustrates a top perspective view of the ball valve 1782. FIG. 17F illustrates a sectional view of the ball valve 1782 along section line 17F-17F shown in FIG. 17D.

Figure 17B:
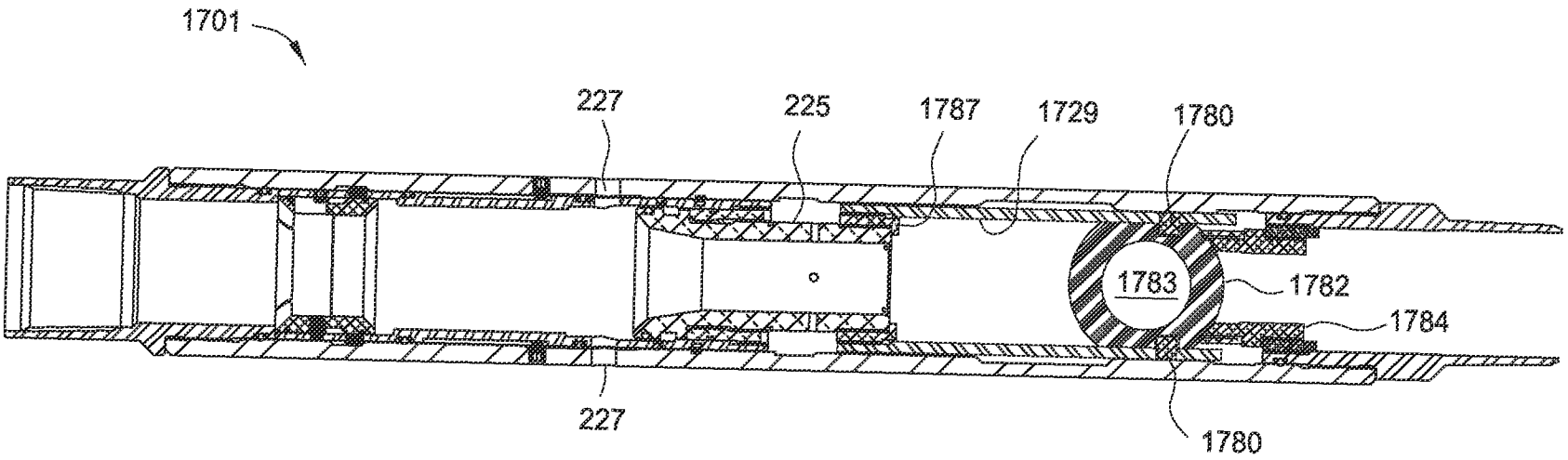

The ball valve 1782 may be rotated, for example, about 90 degrees, about an axis perpendicular to the bore of the shifting tool 1701, to restrict or prevent fluid flow through the bore of the shifting tool 1701, as illustrated in FIG. 17B. During operation, a pressure differential is created across the opening sleeve 225 to shift the opening sleeve 225 in a downward or downhole direction, as explained above with respect to FIGS. 2A-2F. Actuation of the opening sleeve 225 results in concurrent actuation of the window sub 1729, which is coupled to the opening sleeve 225 via a threaded adapter 1787. Downward actuation of the window sub 1729 moves the ball pins 1780 relative to the ball valve 1782 downward through the grooves 1781 of the ball valve 1782. Movement of the opening sleeve 225 results in exposure of the ports 227, facilitating fluid flow therethrough. The rotational movement of the ball valve 1782 is proportional to and limited by the length of travel of the opening sleeve 225.

The movement of the ball pins 1780 effects rotational movement of the ball valve 1782 as the ball pins 1780 travel along the grooves 1781 due to the orientation of groove. Downward movement of the ball valve 1782 in response to the downward movement of the ball pins 1780 is prevented by the ball valve 1784, thereby facilitating rotational movement of the ball valve 1782. The rotational movement of the ball valve 1782 positions the axis of the opening 1783 perpendicular to the axis of the bore of the shifting tool 1701, thereby preventing fluid flow therethrough. With the ball valve 1782 in the closed position, fluid is directed through the ports 227, which are opened due to shifting of the window sub 1729.

Figure 17C:
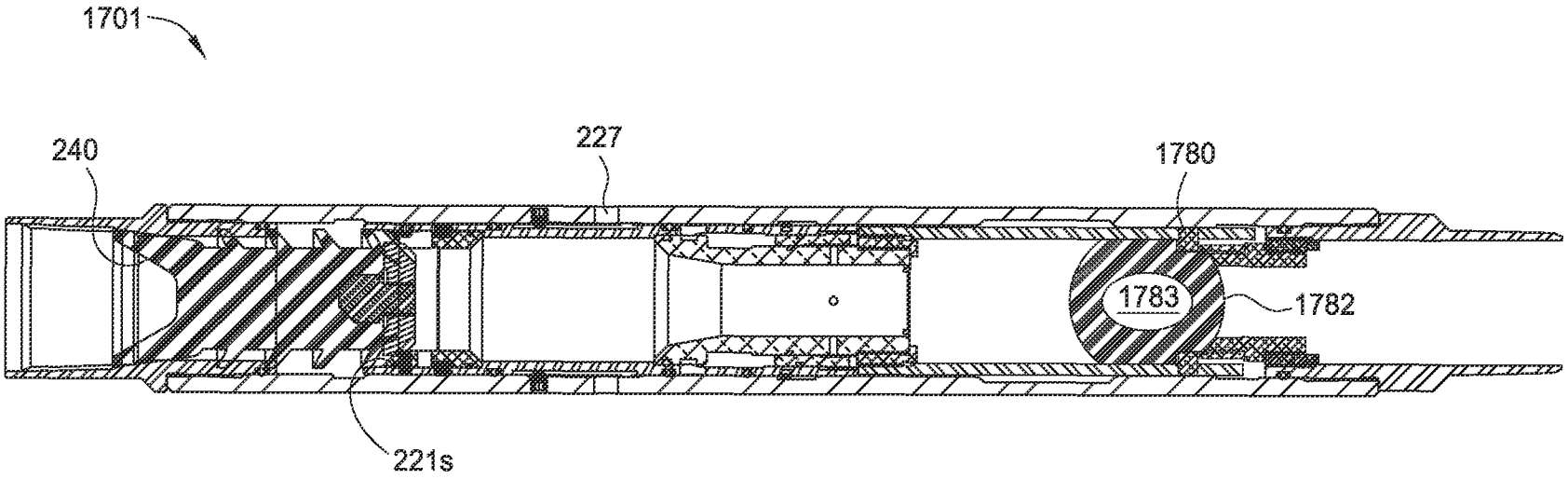
Figure 17E:
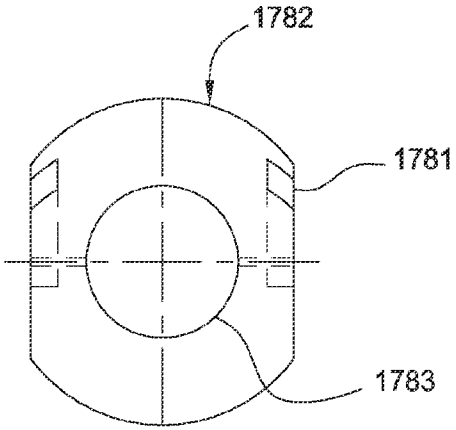
Figure 17F:
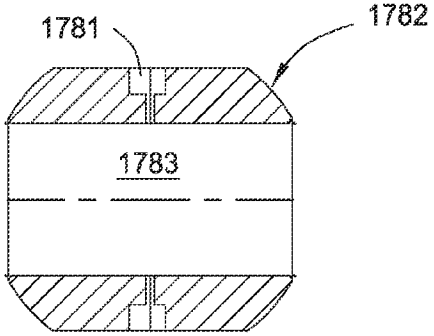
Figure 17D:
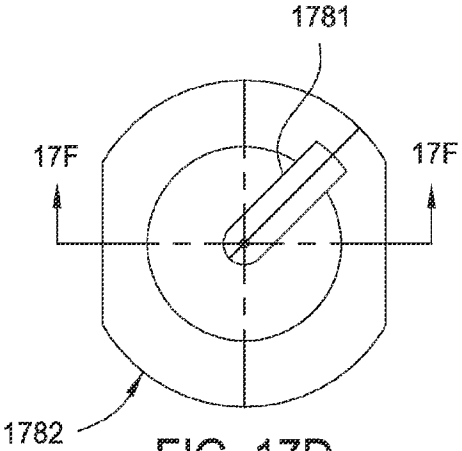

After completion of a desired operation, for example, supplying cement and/or a chasing fluid down the wellbore, a wiper plug 240 is launched downhole, as shown in FIG. 17C. The wiper plug 240 engages a seat 221*s* of the closing seat assembly 221, and pressure applied to the wiper plug 240 results in downward actuation of the closing seat assembly 221. Actuation of the closing seat assembly 221 results in concurrent actuation of a closing sleeve 223 and the opening sleeve 225 which are coupled to the closing seat assembly 221, as described above with respect to FIGS. 2A-2F, to facilitate closing of the ports 227.

Once the port 227 is closed, any further attempt to downwardly actuate the wiper plug 240 would normally result in a hydraulic lock, thereby preventing travel of the wiper plug 240. However, in response to applied pressure to the wiper plug 240 with the port 227 closed, the ball valve 1782 may optionally continue to rotate as the pin 1780 continues to travel in the slot 1781, due to the continued downward movement of the opening sleeve 225 in response to the applied pressure in on the wiper plug 240. The continued rotation of the ball valve 1782 partially exposes the opening 1783 through the ball valve 1782 to the bore of the shifting tool 1701, thereby allowing fluid to travel therethrough, thus preventing a hydraulic lock situation. In one example, the ball valve 1782 may rotate an additional 5 to 30 degrees to partially expose the opening 1783 to the bore of the shifting tool 1701. It is contemplated that more or less rotation may occur in instances where desired to expose the opening 1783. Subsequently, the shifting tool 1701 may be drilled out, as explained above.

While embodiments herein generally describe the formation of seals, and action of sealing, using an isolation mechanism, it is to be understood that sealing is intended to mean complete sealing, or a significant or substantial restriction of flow, unless otherwise noted. Additionally, while embodiments herein are generally discussed with respect to single flapper elements, it is contemplated that any number of flapper segments may be utilized to isolate the bore (for example, a tri-flapper mechanism).

Benefits of this disclosure include stage tools which close and seal more reliably than stage tools which rely on balls and ball seats for tubular isolation. In addition, benefits described herein include the ability to confirm stage tool operation and isolation. Moreover, embodiments herein are able to compensate for hydraulic situations.

While the foregoing is directed to embodiments of the present disclosure, other and further embodiments of the disclosure may be devised without departing from the basic scope thereof, and the scope thereof is determined by the claims that follow.

We claim:

1. A stage tool, comprising:

a tubular body having one or more ports formed through a sidewall thereof; and an isolation mechanism disposed in the tubular body, the isolation mechanism having:

a window sub;

a flapper mount coupled to the window sub;

a flapper coupled to the flapper mount, the flapper pivotable between an open position and a closed position;

an opening sleeve axially movable from a first position that closes the one or more ports to a second position that exposes the one or more ports, wherein the flapper mount, the window sub, and the opening sleeve are axially movable together; and a closing sleeve axially movable from a first position that exposes the one or more ports to a second position that closes the one or more ports.

2. The stage tool of claim 1, further comprising a closing seat assembly having a seat adapted to engage a plug or dart, the closing seat assembly coupled to the closing sleeve by one or more shearable fasteners.

3. The stage tool of claim 1, wherein the opening sleeve is coupled to the closing sleeve by a shearable fastener in the first position of the opening sleeve.

4. The stage tool of claim 1, wherein the flapper is maintained in an open position by an interference fit when the opening sleeve is in the first position.

5. The stage tool of claim 4, further comprising a recess formed in an inner surface of the tubular, the recess allowing the flapper to pivot to a closed position.

6. The stage tool of claim 1, further comprising one or more ports formed in the closing sleeve, wherein the one or more ports of the closing sleeve are aligned with the one or more ports of the tubular body when the closing sleeve is in the first position.

7. The stage tool of claim 1, wherein the opening sleeve is actuatable by the application of a hydraulic differential thereacross.

8. A stage tool, comprising:

a tubular body having one or more ports formed through a sidewall thereof; and an isolation mechanism disposed in the tubular body, the isolation mechanism having:

a window sub;

a flapper mount coupled to the window sub;

a flapper coupled to the flapper mount, the flapper pivotable from an open position to a closed position;

an opening sleeve axially movable from a first position that closes the one or more ports to a second position that exposes the one or more ports;

a flapper shaft axially movable from a first position that maintains the flapper in the open position to a second position that allows the flapper to pivot to the closed position;

a spring positioned in a recess of the flapper shaft, the spring engaging the flapper shaft and the flapper mount; and a closing sleeve axially movable from a first position that exposes the one or more ports to a second position that closes the one or more ports.

9. The stage tool of claim 8, wherein the first position of the flapper shaft is up hole of the second position of the flapper shaft.

10. The stage tool of claim 8, wherein the flapper shaft is coupled to a flapper shaft piston, the flapper shaft piston coupled to a bottom sub by a shearable fastener.

11. The stage tool of claim 10, wherein the spring biases the flapper shaft in a down hole direction, and wherein shearing of the shearable fastener allows actuation of the flapper shaft.

12. The stage tool of claim 8, further comprising a closing seat assembly having a seat adapted to engage a plug or dart, the closing seat assembly coupled to the closing sleeve by one or more shearable fasteners.

13. The stage tool of claim 8, wherein the opening sleeve is coupled to the closing sleeve by a shearable fastener in the first position of the opening sleeve.

14. A stage tool, comprising:

a tubular body having one or more ports formed through a sidewall thereof; and an isolation mechanism disposed in the tubular body, the isolation mechanism having:

a window sub;

a flapper mount coupled to the window sub;

a flapper coupled to the flapper mount, the flapper pivotable from an open position to a closed position;

an opening sleeve axially movable from a first position that closes the one or more ports to a second position that exposes the one or more ports;

a flapper shaft axially movable from a first position that maintains the flapper in the open position to a second position that allows the flapper to pivot to the closed position;

a closing sleeve axially movable from a first position that exposes the one or more ports to a second position that closes the one or more ports; and a shaft torque stop disposed down hole of the flapper shaft, the shaft toque stop having a recess formed therein for accepting a torque member extending from the flapper shaft.

15. A stage tool, comprising:

a tubular body having one or more ports formed through a sidewall thereof; and an isolation mechanism disposed in the tubular body, the isolation mechanism having:

a window sub;

a lower sub;

a spring biased against the window sub and the lower sub;

a flapper mount coupled to the window sub, the flapper mount having one or more j-slots formed therein, wherein the flapper mount is coupled to the lower sub by one or more alignment screws disposed in the j-slot;

a flapper coupled to the flapper mount, the flapper pivotable from an open position to a closed position;

an opening sleeve axially movable from a first position that closes the one or more ports to a second position that exposes the one or more ports; and a closing sleeve axially movable from a first position that exposes the one or more ports to a second position that closes the one or more ports.

* * * * *